US011091964B1

(12) United States Patent
Whitfill et al.

(10) Patent No.: US 11,091,964 B1
(45) Date of Patent: Aug. 17, 2021

(54) METHOD TO MANAGE TANDEM SINGLE STRING REACTIVE LCM PILL APPLICATIONS

(71) Applicant: Halliburton Energy Services, Inc., Houston, TX (US)

(72) Inventors: Donald Lee Whitfill, Ponca City, OK (US); Dale E. Jamison, Humble, TX (US); Vitor Lopes Pereira, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/110,805

(22) Filed: Dec. 3, 2020

Related U.S. Application Data

(60) Provisional application No. 63/000,184, filed on Mar. 26, 2020.

(51) Int. Cl.
*E21B 33/138* (2006.01)
*E21B 21/00* (2006.01)

(52) U.S. Cl.
CPC ..... *E21B 21/003* (2013.01); *E21B 33/138* (2013.01)

(58) Field of Classification Search
CPC ..... E21B 21/003; E21B 33/138
USPC ..... 175/72; 176/72
See application file for complete search history.

(56) References Cited

U.S. PATENT DOCUMENTS 4,120,369 A 10/1978 Fischer et al.
4,958,685 A 9/1990 Hihara et al.
5,913,364 A * 6/1999 Sweatman ..... C09K 8/035 166/281
6,664,215 B1 * 12/2003 Tomlinson ..... C04B 9/02 507/269

(Continued)

FOREIGN PATENT DOCUMENTS

WO 2005078235 A1 8/2005
WO 2008077499 A1 7/2008
WO 2020142064 A1 7/2020

OTHER PUBLICATIONS

Filing Receipt, Specification and Drawings for U.S. Appl. No. 63/000,184, entitled "Method to Manage Tandem Single String Reactive LCM Pill Applications," filed Mar. 26, 2020, 61 pages.

(Continued)

*Primary Examiner* — Zakiya W Bates
*Assistant Examiner* — Ashish K Varma
(74) *Attorney, Agent, or Firm* — Conley Rose, P.C.; Rodney B. Carroll

(57) ABSTRACT

A method of sealing a lost circulation zone (LCZ) during a drilling operation by: positioning a bottom hole assembly (BHA) at an initial position proximate a LCZ in a wellbore, wherein the BHA includes a drill bit fluidly connected with a surface of the wellbore via a drill string; and pumping first and second reactant pills and a spacer into the LCZ via the drill string and the drill bit, wherein the first reactant pill includes one or more first reactants, wherein the second reactant pill includes one or more second reactants, wherein the first reactant pill is pumped into the LCZ prior to the second reactant pill due to introducing of the spacer into the drill string between the first and second reactant pills, and wherein, after a reaction time, reactants comprising the one (Continued)

or more first and second reactants react within and provide a seal of the LCZ.

20 Claims, 13 Drawing Sheets

(56) References Cited

U.S. PATENT DOCUMENTS

| | | | | |
|---|---|---|---|---|
| 7,350,576 | B2 * | 4/2008 | Robertson | C04B 28/32 166/292 |
| 9,822,625 | B2 * | 11/2017 | Savari | E21B 43/25 |
| 2005/0167159 | A1 * | 8/2005 | Bailey | C09K 8/03 175/72 |
| 2005/0199390 | A1 | 9/2005 | Curtice et al. | |

OTHER PUBLICATIONS

Abdulrazzaq, Waseem et al., "Chemical Sealant Loss Circulation Materials for Fractured Formations: Right-Angle Viscosity Development with High Plugging Efficiency," SPE Kingdom of Saudi Arabia Annual Technical Symposium and Exhibition, Apr. 2018, SPE-192328-MS, 9 pages, Society of Petroleum Engineers.

Savari, Sharath et al., "Next-Generation, Right-Angle-Setting Composition for Eliminating Total Loss Circulation," presented at SPE/IADC Middle East Drilling Technology Conference and Exhibition, Oct. 2013, SPE/IADC 166697, 5 pages, SPE/IADC Middle East Drilling Technology Conference and Exhibition.

Tirado, Guillermo et al., "A Novel Heat-Activation RSF to Treat Severe Case of Lost Circulation: Case Histories from Mexico," presented at IADC/SPE Drilling Conference, Mar. 2008, IADC/SPE 112645, 15 pages, IADC/SPE Drilling Conference.

Vasquez, Julio et al., "A Novel Temperature-Activated, Rigid-Setting Material: Case Histories and Lessons Learned After More than 500 Well Interventions for Drilling and Conformance Applications," presented at SPE Annual Technical Conference and Exhibition, Oct. 2013, SPE 166221, 10 pages, Society for Petroleum Engineers.

Vasquez, J., "A Novel Temperature-Activated, Rigid-Setting Material: Case Histories for Drilling and Conformance Offshore Applications," presented at Offshore Technology Conference Brazil, Oct. 2013, OTC 24417, 13 pages, Offshore Technology Conference.

Foreign Communication from Related Application—International Search Report and Written Opinion of the International Searching Authority, International Application No. PCT/US2020/063899, dated Mar. 18, 2021, 12 pages.

* cited by examiner

METHOD TO MANAGE TANDEM SINGLE STRING REACTIVE LCM PILL APPLICATIONS

CROSS-REFERENCE TO RELATED APPLICATIONS

This application claims priority under 35 U.S.C. § 119(e) to U.S. Provisional Patent Application No. 63/000,184 filed on Mar. 26, 2020 and entitled "Method to Manage Tandem Single String Reactive LCM Pill Applications," the disclosure of which is hereby incorporated herein by reference in its entirety.

STATEMENT REGARDING FEDERALLY SPONSORED RESEARCH OR DEVELOPMENT

Not applicable.

TECHNICAL FIELD

The present disclosure relates generally to methods of servicing a wellbore. More specifically, it relates to methods of sealing lost circulation zones.

BACKGROUND

Natural resources such as gas, oil, and water residing in a subterranean formation or zone are usually recovered by drilling a wellbore down to the subterranean formation while circulating a drilling fluid in the wellbore. During drilling or other wellbore servicing operations, lost circulation can occur when drilling fluid, also commonly known as "mud", or another wellbore servicing fluid flows into one or more geological formations rather than returning up the annulus. Such loss of drilling fluid or other wellbore servicing fluid to a loss circulation zone can be detrimental to the drilling or other wellbore servicing operation. Accordingly, it is desirable to provide methods for sealing such loss circulation zones, such that drilling or other wellbore servicing fluid loss to the lost circulation zone is ceased.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
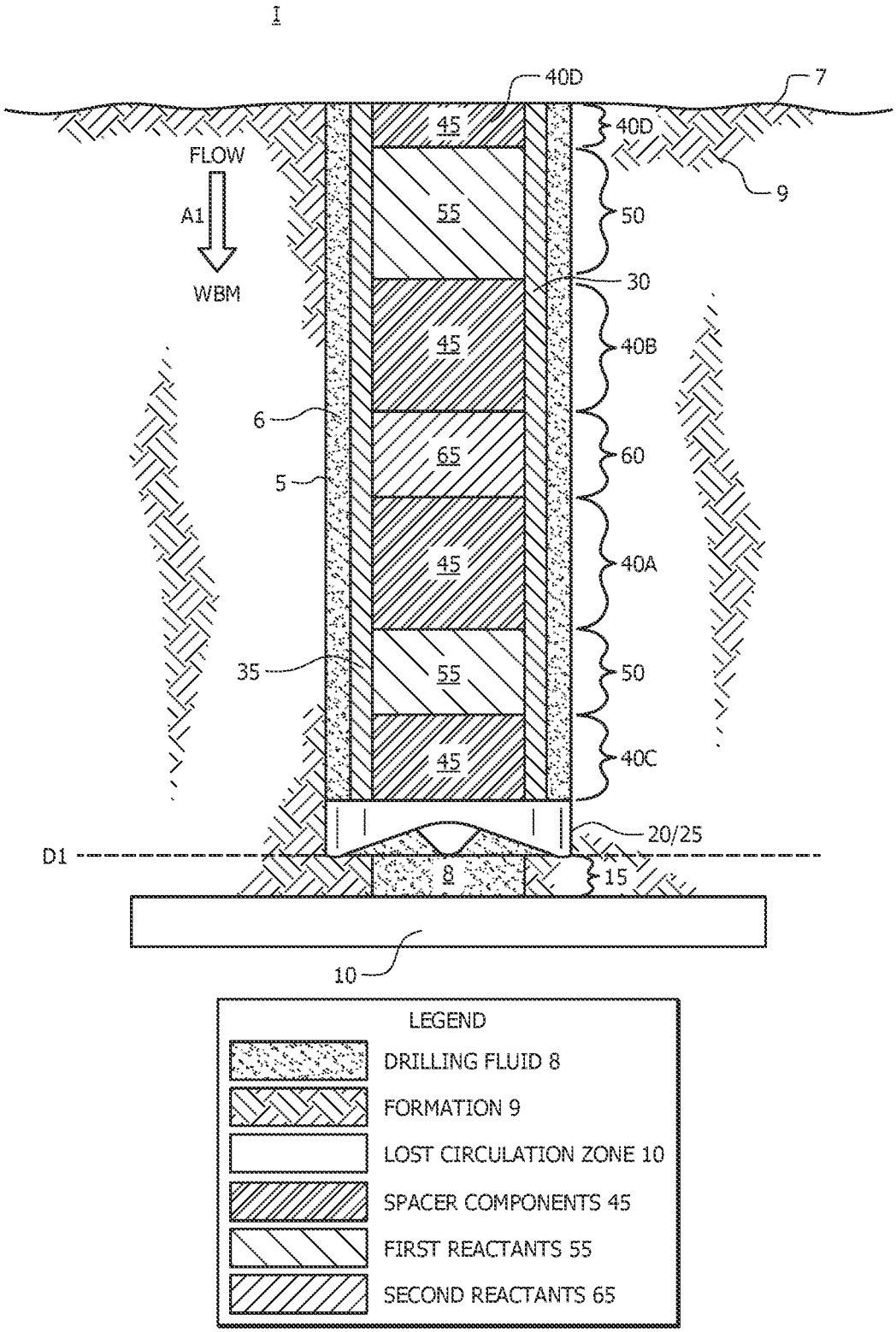
FIG. 1A is a schematic of a wellbore servicing system in which a method of sealing a lost circulation zone according to this disclosure has been initiated.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

A descriptor numeral can be utilized generically herein to refer to any embodiment of that component. For example, generic reference to a "spacer 40" can indicate any spacer 40, such a spacer 40A introduced into a drill string 35 immediately after a first reactant pill 50, a spacer 40B introduced into the drill string immediately after a second reactant pill 60, a spacer 40C introduced into the drill string 35 prior to introduction of a 1$^{st}$ first reactant pill 50 thereto, a spacer 40D introduced into the drill string 35 subsequent introduction of a last or final reactant pill 50/60 (e.g., a final first reactant pill 50 or second reactant pill 60, whichever is introduced last) thereto and so on.

For brevity, reference to "first reactants" is utilized to indicate "one or a plurality of first reactants". Likewise, for brevity, reference to "second reactants" is utilized to indicate "one or a plurality of second reactants.

Disclosed herein is a method of sealing a lost circulation zone during a drilling operation. The method includes: positioning a bottom hole assembly (BHA) at an initial position proximate a lost circulation zone in a wellbore, wherein the BHA includes a drill bit fluidly connected with a surface of the wellbore via a drill string; and pumping a first reactant pill, a spacer, and a second reactant pill into the lost circulation zone via the drill string and the drill bit, wherein the first reactant pill includes one or a plurality of first reactants, wherein the second reactant pill includes one or a plurality of second reactants, wherein the spacer is not reactive with the one or the plurality of first reactants or with the one or the plurality of second reactants, and wherein, after a reaction time, reactants including the one or the plurality of first reactants of the first reactant pill and the one or the plurality of second reactants of the second reactant pill react within and provide a seal of the lost circulation zone. The method can further include drilling through the seal and continuing the drilling operation. The first reactant pill can be pumped into the lost circulation zone prior to pumping of the second reactant pill into the lost circulation zone by introducing the spacer into the drill string between introducing the first reactant pill into the drill string and introducing the second reactant pill into the drill string.

Lost circulation occurs when the drill bit penetrates a formation that has natural fractures or vugulars ("vugs"), or when a fracture is initiated by high pressures in the borehole. Whole mud is lost to the formation during these lost circulation events. The most common way to cure the lost circulation is to pump particulate material of different types and particle size distributions in a carrier fluid of various types. If this is not successful, chemical sealants such as Gunk Squeezes, cross-linked polymers, resins, Portland cements and Sorrell Cements may be employed to cure the lost circulation. The herein disclosed method of sealing a lost circulation zone can be utilized to seal a lost circulation zone with such a chemical sealant.

Description of aspects of the method will now be made with reference to FIG. 1A, which is a schematic of a wellbore servicing system I in which a method of sealing a lost circulation zone according to this disclosure has been initiated. As depicted in FIG. 1A, the method includes: positioning a bottom hole assembly (BHA) 20 at an initial position or depth D1 proximate a lost circulation zone 10 in a wellbore 5. The BHA 20 includes a drill bit 25 that is fluidly connected with a surface 7 of the wellbore 5 via a drill pipe 30. The method further includes pumping a first reactant pill 50, a spacer 40A, and a second reactant pill 60 into the lost circulation zone 10 via the drill pipe 30 and the drill bit 25. The first reactant pill 50 includes one or a plurality of first reactants 55, the second reactant pill 60 includes one or a plurality of second reactants 65, and the spacer 40A includes one or more spacer components 45 that are not reactive with the one or the plurality of first reactants 55 of the first reactant pill 50 or with the one or the plurality of second reactants 65 of the second reactant pill 60. The first reactant pill 50 can be pumped into the lost circulation zone 10 prior to pumping of the second reactant pill 60 into the lost circulation zone 10 due to introducing of the spacer 40A into the drill pipe 30 between introducing into the drill pipe 30 of the first reactant pill 50 and introducing into the drill pipe 30 of the second reactant pill 60. As described further hereinbelow with reference to FIG. 2H and FIG. 2I, after a reaction time, reactants including the one or the plurality of first reactants 55 of the first reactant pill 50 and the one or the plurality of second reactants 65 of the second reactant pill 60 react within and provide a seal 85 of the lost circulation zone 10. The method can further include drilling through the seal 85 and continuing the drilling operation.

As depicted in FIG. 1A, prior to the pumping of the first reactant pill 50, the spacer 40A, and the second reactant pill 60 into the lost circulation zone 10, the wellbore 5 can contain a water based drilling fluid 8 (also referred to as a water based mud (WBM) 8). For example, WBM 8 can be present and/or have been introduced into the drill string 35 (e.g., the drill pipe 30 and the BHA 20) and annulus 6 of the wellbore 5 (annulus 6 is between the drill string 35 and walls of wellbore 5) prior to introducing the first reactant pill 50 into the drill pipe 30. In such aspects, the first reactant pill 50, the second reactant pill 60, or both the first reactant pill 50 and the second reactant pill 60 can be water based pills, and the spacer 40A can be an oil-based spacer 40A (also referred to herein as an oil based pill 40A or OB pill 40A). As depicted in FIG. 1A, an oil based spacer 40C can be introduced into the drill pipe 30 prior to the introducing the first reactant pill 50 into the drill pipe 30 to prevent mixing of the first reactant pill 50 with the (in this case water based) drilling fluid present in the drill string 35 upon initiation of the method. FIG. 1A shows the configuration after pumping the spacer 40C, the first reactant pill 50, the spacer 40A, and the second reactant pill 60 into the drill string 35, in the direction indicated by arrow A1, such that the spacer 40C has reached the BHA 20 including drill bit 25. At this point in the method, a region 15 outside and adjacent the BHA 20 and the annulus 6 can include drilling fluid 8, which in the wellbore servicing system I of FIG. 1A includes WBM, the loss of which to the lost circulation zone 10 is being treated by the method.

Figure 1B:
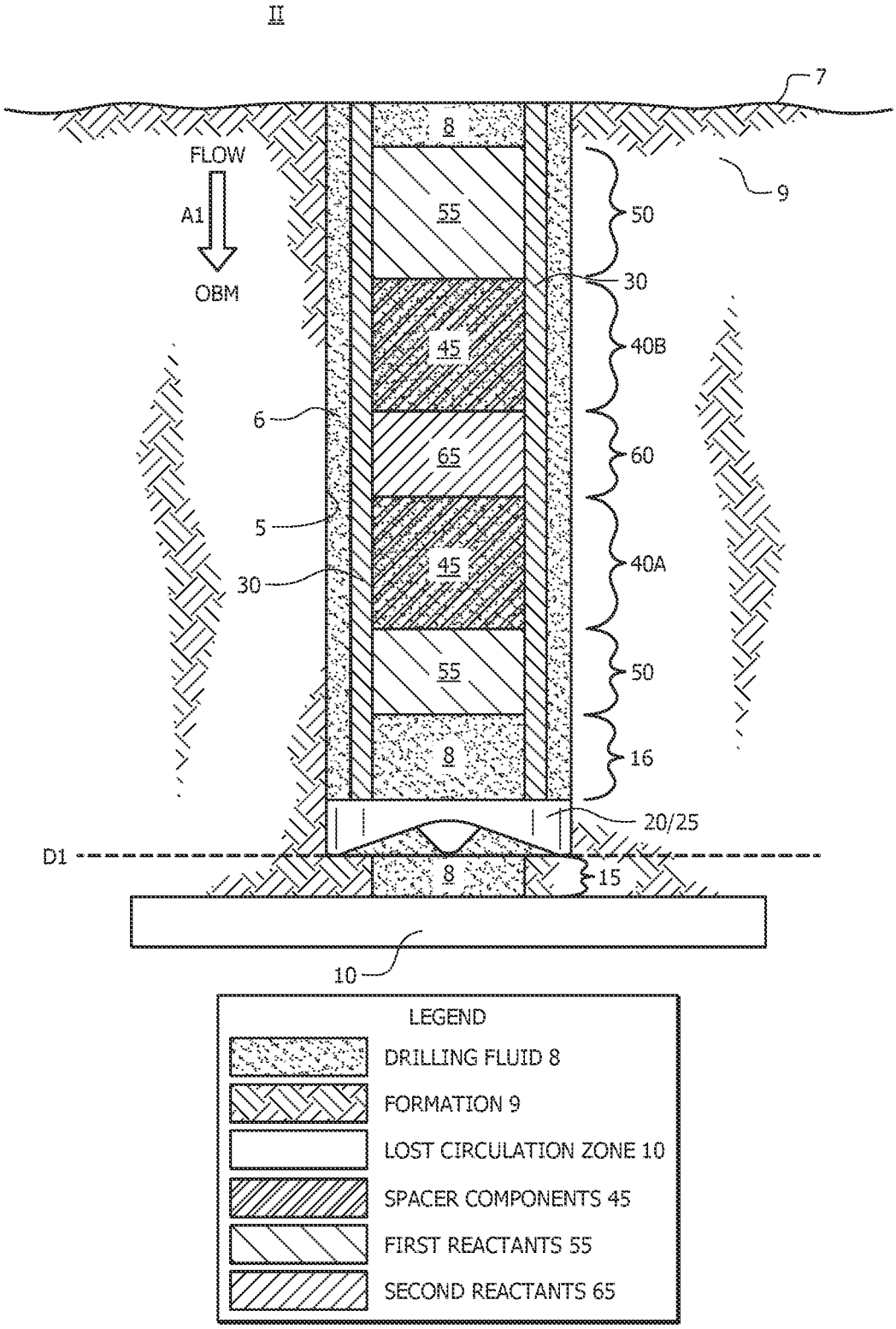
FIG. 1B is a schematic of another wellbore servicing system in which a method of sealing a lost circulation zone according to this disclosure has been initiated.

Description of other aspects of the method will now be made with reference to FIG. 1B, which is a schematic of a wellbore servicing system II in which a method of sealing a lost circulation zone according to this disclosure has been initiated. As depicted in FIG. 1B, the method includes: positioning bottom hole assembly (BHA) 20 at initial position or depth D1 proximate lost circulation zone 10 in wellbore 5. The BHA 20 includes the drill bit 25 that is fluidly connected with surface 7 of the wellbore 5 via drill pipe 30. The method further includes pumping first reactant pill 50, spacer 40A, and a second reactant pill 60 into the lost circulation zone 10 via the drill pipe 30 and the drill bit 25. Again, first reactant pill 50 includes one or a plurality of first reactants 55, second reactant pill 60 includes one or a plurality of second reactants 65, and spacer 40A includes one or more spacer components 45 that are not reactive with the one or the plurality of first reactants 55 of the first reactant pill 50 or with the one or the plurality of second reactants 65 of the second reactant pill 60. The first reactant pill 50 can be pumped into the lost circulation zone 10 prior to pumping of the second reactant pill 60 into the lost circulation zone 10 due to introducing of the spacer 40A into the drill pipe 30 between introducing into the drill pipe 30 of the first reactant pill 50 and introducing into the drill pipe 30 of the second reactant pill 60. As described further hereinbelow with reference to FIG. 2H and FIG. 2I, after a reaction time, reactants including the one or the plurality of first reactants 55 and the one or the plurality of second reactants 65 react within and provide seal 85 of the lost circulation zone 10. The method can further include drilling through the seal 85 and continuing the drilling operation.

As depicted in FIG. 1B, prior to the pumping of the first reactant pill 50, the spacer 40A, and the second reactant pill 60 into the lost circulation zone 10, the wellbore 5 can contain an oil based drilling fluid 8 or oil based mud (OBM). For example, OBM drilling fluid 8 can be present and/or have been introduced into the drill string (e.g., the drill pipe 30 and the BHA 20) and annulus 6 of the wellbore 5 (which annulus 6 is between the drill string 35 and the walls of wellbore 5) prior to introducing the first reactant pill 50 into the drill pipe 30. In such aspects, the first reactant pill 50, the second reactant pill 60, or both the first reactant pill 50 and the second reactant pill 60 can be water based pills, and the spacer 40A can be an oil-based spacer 40A (also referred to herein as an oil based pill 40A or OB pill 40A). The spacer 40A can include the drilling fluid 8 (i.e., the OBM), or another oil based spacer. FIG. 1B shows the configuration after pumping the first reactant pill 50, the spacer 40A, and the second reactant pill 60 into the drill string 35 such that the first reactant pill 50 has almost reached the BHA 20/drill bit 25, and the drilling fluid (i.e., the OBM) that was present in the drill string 35 upon initiation of the method (e.g., upon introducing of the first reactant pill 50 into the drill string 35) has been pumped through the wellbore such that only a region 16 within drill string 35 adjacent the BHA 20/drill bit 25 includes the drilling fluid 8 that was present in drill string 35 upon initiation of the method. At this point in the method depicted in FIG. 1B, region 15 outside and adjacent the BHA 20 and annulus 6 include drilling fluid 8, which in this aspect of FIG. 1B includes OBM, the loss of which to the lost circulation zone 10 is being treated by the method. As the drill string 35 includes OBM prior to introducing the first reactant pill 50 thereto, introduction of a spacer 40 may not be needed prior to introduction into the drill string 35 of the (e.g., initial or $1^{st}$) first reactant pill 50, which, in this example, is a water based first reactant pill 50.

Although described herein with reference to a drilling fluid, a method of sealing a lost circulation zone 10 can be utilized for sealing a lost circulation zone during wellbore servicing operations employing other wellbore servicing fluids (WSF) other than drilling fluids. In an aspect, the WSF may include any suitable WSF. As used herein, a "servicing fluid" or "treatment fluid" refers generally to any fluid that may be used in a subterranean application in conjunction with a desired function and/or for a desired purpose, including but not limited to fluids used to drill, complete, work over, fracture, repair, clean, or in any way prepare a wellbore 5 for the recovery of materials residing in a subterranean formation 9 penetrated by the wellbore 5. The servicing fluid is for use in a wellbore 5 that penetrates a subterranean formation 9. It is to be understood that "subterranean formation" 9 encompasses both areas below exposed earth (e.g., below surface 7) and areas below earth covered by water such as ocean or fresh water. In an aspect, the WSF as disclosed herein can be a drilling fluid or a completion fluid. In an aspect, the WSF as disclosed herein can be a drilling fluid 8. In an aspect, the WSF includes a base fluid. In some aspects, the base fluid is an aqueous fluid. In other aspects, the base fluid includes an emulsion.

The wellbore servicing fluid or drilling fluid 8 can have monovalent and/or polyvalent cations, alkali and alkaline earth metals, or combinations thereof. Additional examples of suitable salts include NaCl, KCl, NaBr, $CaCl_2$), $CaBr_2$, $MgCl_2$, $MgBr_2$, $ZnBr_2$, acetate salts, sodium acetate, potassium acetate, ammonium chloride ($NH_4Cl$), potassium phosphate, sodium formate, potassium formate, cesium formate, or combinations thereof. In an aspect, the WSF (e.g., the base fluid of the WSF or drilling fluid 8) includes a brine comprising the salt.

In an aspect, the base fluid includes an aqueous fluid. Aqueous fluids that may be used in the WSF include any aqueous fluid suitable for use in subterranean applications, provided that the aqueous fluid is compatible with the other components (e.g., shale inhibitor) used in the WSF. For example, the aqueous fluid may include water or a brine. In an aspect, the aqueous fluid includes an aqueous brine. In an aspect, the WSF suitable for use in the present disclosure may include any suitable salt(s). In such aspect, the aqueous brine generally includes water and an inorganic monovalent salt, an inorganic multivalent salt, or both. The aqueous brine may be naturally occurring or artificially-created. Water present in the brine may be from any suitable source, examples of which include, but are not limited to, sea water, tap water, freshwater, water that is potable or non-potable, untreated water, partially treated water, treated water, produced water, city water, well-water, surface water, liquids including water-miscible organic compounds, and combinations thereof. The salt or salts in the water may be present in an amount ranging from greater than about 0% by weight to a saturated salt solution, alternatively from about 1 wt. % to about 30 wt. %, or alternatively from about 5 wt. % to about 10 wt. %, based on the weight of the salt solution. In an aspect, the salt or salts in the water may be present within the base fluid in an amount sufficient to yield a saturated brine. As will be appreciated by one of skill in the art, and with the help of this disclosure, the type and concentration of salt solutions utilized as a base fluid is dependent on the WSF density (e.g., drilling fluid density, completion fluid density, etc.), which may range, without limitation, from about 8 lb/gallon to about 20 lb/gallon, alternatively from about 10 lb/gallon to about 18 lb/gallon, or alternatively from about 12 lb/gallon to about 16 lb/gallon.

Nonlimiting examples of aqueous brines suitable for use in the present disclosure include chloride-based, bromide-based, phosphate-based or formate-based brines containing monovalent and/or polyvalent cations, salts of alkali and alkaline earth metals, or combinations thereof. Additional examples of suitable brines include, but are not limited to brines including salts such as NaCl, KCl, NaBr, $CaCl_2$), $CaBr_2$, $MgCl_2$, $MgBr_2$, $ZnBr_2$, acetate salts, sodium acetate, potassium acetate, ammonium chloride ($NH_4Cl$), potassium phosphate, sodium formate, potassium formate, cesium formate, or combinations thereof. In an aspect, the base fluid includes a brine.

In an aspect, the base fluid includes an emulsion. In such aspect, the emulsion can be an oil-in-water emulsion including a non-oleaginous (e.g., an aqueous fluid of the type previously described herein) continuous phase and an oleaginous (e.g., an oil-based fluid, such as for example an oleaginous fluid) discontinuous phase. Oleaginous fluids that may be used in the WSF include any oleaginous fluid suitable for use in subterranean applications, provided that the oleaginous fluid is compatible with the other components utilized in the WSF. Examples of oleaginous fluids suitable for use in a WSF include, but are not limited to, petroleum oils, natural oils, synthetically-derived oils, oxygenated fluids, or combinations thereof. In an aspect, the oleaginous fluid includes diesel oil, kerosene oil, mineral oil, synthetic oils, aliphatic hydrocarbons, polyolefins (e.g., alpha olefins, linear alpha olefins and/or internal olefins), paraffins, silicone fluids, polydiorganosiloxanes, oxygenated solvents, esters, diesters of carbonic acid, alcohols, alcohol esters, ethers, ethylene glycol, ethylene glycol monoalkyl ether, ethylene glycol dialkyl ether, or combinations thereof, wherein the alkyl groups are methyl, ethyl, propyl, butyl, and the like.

The base fluid may be present within the WSF in any suitable amount. For example, the base fluid may be present within the WSF in an amount of from about 10 wt. % to about 99 wt. %, alternatively from about 20 wt. % to about 95 wt. %, or alternatively from about 40 wt. % to about 90 wt. %, based on the total weight of the WSF. Alternatively, the base fluid may include the balance of the WSF after considering the amount of the other components used. As will be appreciated by one of skill in the art, and with the help of this disclosure, the amount of base fluid (e.g., aqueous base fluid) in the WSF depends on the desired density of the WSF.

One or more of the spacers 40A, 40B, 40C, and 40D can be oil based spacers comprising any of the oleaginous fluids noted hereinabove. For example, as described with reference to FIG. 1B, when the wellbore 5 comprises an oil based drilling fluid 8 when the method of sealing the lost circulation zone 10 is initiated, the spacer(s) 40A introduced into the drill pipe 30 immediately after introduction thereto of a first reactant pill 50 and/or the spacer(s) 40B introduced into the drill pipe 30 immediately after introduction thereto of a second reactant pill 60 can comprise the oil based drilling fluid 8. In the aspect described with reference to FIG. 1A, when the wellbore 5 comprises a water based drilling fluid 8 when the method of sealing the lost circulation zone 10 is initiated, the spacer(s) 40A introduced into the drill pipe 30 immediately after introduction thereto of a first reactant pill 50, the spacer(s) 40B introduced into the drill pipe 30 immediately after introduction thereto of a second reactant pill 60, a spacer 40C into the drill pipe 30 immediately prior to introduction thereto of a first reactant pill 50, and/or a spacer 40D introduced into the drill pipe 30 immediately after introduction thereto of a final reactant pill (e.g., a final first reactant pill 50 or a final reactant pill 60, whichever is the final of the first and second reactant pills 50/60 introduced into the drill string 30 during the lost circulation treatment) can comprise a pill of any suitable oil based fluid, such as the oleaginous fluids mentioned above for use in a WSF.

The one or the plurality of first reactant pill(s) and the one or the plurality of second reactant pill(s) 60 can comprise any suitable carrier fluid (or no carrier fluid) for the first reactants 55 and the second reactants 65, respectively. In aspects in which the first reactant pill(s) and the second reactant pill(s) 60 are water based reactant pills 50/60, the carrier can be any aqueous fluid, such as, without limitation, the aqueous fluids noted hereinabove for use in the WSF. Although described herein with reference to water based reactant pills 50/60, in aspects, one or more of the first reactant pill(s) and/or the second reactant pill(s) 60 utilized in a method of sealing the lost circulation zone 10 according to this disclosure can comprise oil based reactant pills 50/60. In aspects in which the first reactant pill(s) and the second reactant pill(s) 60 are oil based reactant pills 50/60, a carrier of the reactants (if present) therein can be any oleaginous fluid, such as, without limitation, the aqueous fluids noted hereinabove for use in the WSF.

As discussed further hereinbelow, a method of this disclosure can include pumping a plurality of first reactant pills 50, a plurality of second reactant pills 60, or both a plurality of first reactant pills 50 and a plurality of second reactant pills 60 into the lost circulation zone 10, wherein each of the plurality of first reactant pills 50, other than a $1^{st}$ of the plurality of first reactant pills 50 introduced into the drill string 35, is introduced into the drill string 35 subsequent introducing into the drill string 35 of a second reactant pill 60 followed by introducing into the drill string 35 of a spacer 40B, and wherein each of the plurality of second reactant pills 60 is introduced into the drill string 35 subsequent introducing into the drill string 35 of a first reactant pill 50 followed by introducing into the drill string of a spacer 40A. In this manner, a total volume of first reactants 55 needed for forming the seal 85 can be introduced into the lost circulation zone 10 via a plurality of first reactant pills 50, wherein the sum of the volumes of first reactants provided by the plurality of first reactant pills 50 is greater than or equal to the total volume of the first reactants 55 needed for the seal 85, and a total volume of second reactants 65 needed for forming the seal 85 can be introduced into the lost circulation zone 10 via a plurality of first reactant pills 50, wherein the sum of the volumes of second reactants provided by the plurality of second reactant pills 60 is greater than or equal to the total volume of the second reactants 65 needed for the seal 85. This can allow for improved mixing of the first reactants 55 with the second reactants 65 within the lost circulation zone 10, and more effective (e.g., a smaller total volume of reactants including first reactants 55 and/or second reactants 65 utilized and/or a smaller volume of each or the plurality of first reactant pills 50 and/or second reactant pills 60) and or more rapid formation of a sufficient seal 85.

The method can include selecting a volume of the first reactant pill 50, a volume of the second reactant pill 60, or both the volume of the first reactant pill 50 and the volume of the second reactant pill 60 to provide sufficient mixing of the one or the plurality of first reactants 55 of the first reactant pill 50 with the one or the plurality of second reactants 65 of the second reactant pill 60 such that, subsequent the pumping of the first reactant pill 50, the spacer 40A, and the second reactant pill 60 into the lost circulation zone 10, the one or the plurality of first reactants 55 and the one or the plurality of second reactants 65 react to plug the lost circulation zone 10.

For example, in FIG. 1A, after introducing second reactant pill 60 into drill pipe 30, a $2^{nd}$ first reactant pill 50 including first reactants 55 has been introduced into drill pipe 30 after introducing a spacer 40B into the drill pipe 30. Generally, a spacer 40 will be introduced into the drill pipe 30 between introduction thereto of each first reactant pill 50 and each second reactant pill 60. Any number of first reactant pills 50 and second reactant pills 60 can be utilized.

For another example, as depicted in FIG. 1B, after introducing second reactant pill 60 into drill pipe 30, a $2^{nd}$ first reactant pill 50 including first reactants 55 is has been introduced into drill pipe 30 after introducing a second spacer 40B into the drill pipe 30. A spacer 40 has been introduced into the drill pipe 30 between introduction thereto of each first reactant pill 50 and each second reactant pill 60. Any number of first reactant pills 50 and second reactant pills 60 can be utilized.

The number of first reactant pills 50, the number of second reactant pills 60, and the number of spacers 40 (e.g., spacers 40A, spacers 40B, and/or $1^{st}$ and final spacers 40C and 40D) utilized is not limited. Generally, as a spacer 40 (40A, 40B) is positioned between each first reactant pill 50 and each second reactant pill 60, the number of spacers 40 can be at least equal to the number of first reactant pills 50. For example, the number of first reactant pills can include from 1 to about n first reactant pills 50, wherein n is about 5, 6, 7, 8, 9, 10, 11, 12, 13, 14, 15, 16, 17, 18, 19, or 20 or more. The number of second reactant pills 60 can equal n, or n−1 second reactant pills 60. For example, the number of second reactant pills 60 can be from 1 to about 5, 6, 7, 8, 9, 10, 11, 12, 13, 14, 15, 16, 17, 18, 19, or 20 or more second reactant pills 60. As a spacer 40 (e.g., 40A, 40B) is introduced into drill string 35 between each first reactant pill 50 and any adjacent second reactant pill 60, and a spacer (e.g., 40C and/or 40D) can be introduced prior to a $1^{st}$ of the first reactant pills 50 introduced into drill string 35 and/or after a last reactant pill (i.e., a final first reactant pill 50 or a final second reactant pill 60 introduced into drill string 35), the number of spacers 40 can be equal to n, n+1, or n+2 spacers. For example, and without limitation, the number of spacers (spacers 40A, 40B, and/or 40C) can be from 1 to about 5, 6, 7, 8, 9, 10, 11, 12, 13, 14, 15, 16, 17, 18, 19, 20, 21, 22 or more spacers 40. In aspects, the number of spacers 40 including spacers 40A plus the number of spacers 40B can be from 1 to about 5, 6, 7, 8, 9, 10, 11, 12, 13, 14, 15, 16, 17, 18, 19, 20, or more. In aspects, the number n of spacers 40 including spacers 40A plus the number of spacers 40B plus the number of spacers 40C/40D can be from 1 to about 5, 6, 7, 8, 9, 10, 11, 12, 13, 14, 15, 16, 17, 18, 19, 20, 21, 22 or more. In aspects, no spacers 40C and/or 40D are utilized.

Although a three reactant pill/spacer scenario is depicted in FIG. 1A and FIG. 1B, there are many possible alternating reactant pill-spacer combinations. For example, in aspects, the volume combination includes first reactant pill 50+separation spacer 40A+second reactant pill 60. An alternative combination is: $1^{st}$ first reactant pill 50+separation spacer 40A+$1^{st}$ second reactant pill 60+separation spacer 40B+$2^{nd}$ first reactant pill 50+separation spacer 40A+$2^{nd}$ second reactant pill 60. Another alternative combination is: $1^{st}$ first reactant pill 50+separation spacer 40A+$1^{st}$ second reactant pill 60+separation spacer 40B+$2^{nd}$ first reactant pill 50+separation spacer 40A+$2^{nd}$ second reactant pill 60+separation spacer 40B+$3^{rd}$ first reactant pill 50+separation spacer 40A+$3^{rd}$ second reactant pill 60+separation spacer 40B+$4^{th}$ first reactant pill 50+separation spacer 40A+$4^{th}$ second reactant pill 60.

The method can include tailoring the number of first reactant pills 50 and/or a volume of the first reactant pill 50 or a volume of each of the first reactant pills 50 of a plurality of first reactant pills 50, and/or a number of second reactant pills 60 and/or a volume of the second reactant pill 60 or a volume of each of the second reactant pills 60 of a plurality of second reactant pills 60 to optimize mixing of the reactants (i.e., the first reactants 55 and the second reactants 65) in the lost circulation zone 10.

The first reactant pill 50 can include one or a plurality of first reactants 55. The second reactant pill 60 can include one or a plurality of second reactants 65. (That is, although referred to herein as "first reactants 55" and "second reactants 65", each of the one or the plurality of first reactant pills 50 can include one or a plurality of first reactants 55, and each of the one or the plurality of second reactant pills 60 can include one or a plurality of second reactants 65. The one or the plurality of first reactants 55 and the one or the plurality of second reactants 65 are selected such that upon reaction thereof, a seal 85 (FIG. 2H) of the lost circulation zone 10 is formed. Any first reactant(s) 55 and second reactant(s) 65 known to those of skill in the art to be reactive to produce a hardened seal 85 can be utilized, without limitation. For example, the seal 85 can include a Sorrell cement. In such aspects, the first reactants 55 can include magnesium oxide (MgO), a zeolite, or a combination thereof. The zeolite can include sepiolite, or a combination thereof. The one or the plurality of second reactants 65 can include magnesium chloride ($MgCl_2$), magnesium sulfate ($MgSO_4$), magnesium phosphate ($MgPO_4$), or a combination thereof.

In embodiments, such as depicted in FIG. 1A and FIG. 1B, the first reactants 55 can include magnesium oxide (MgO) and/or sepiolite, and at least two first reactant pills can be utilized, and the second reactants 65 can include magnesium sulfate heptahydrate ($MgSO_4.7H_2O$), and a single second reactant pill 60 can be utilized. By utilizing a plurality of first reactant pills 50 or second reactant pills 60 to provide a desired amount of first reactants 55 and/or second reactants 65, respectively, to the lost circulation zone 10, a viscosity of the pills can be reduced relative to utilization of a single first reactant pill 55 or a second reactant pill 65. The number of pills (i.e., the number of first reactant pills 50 and/or the number of second reactant pills 65) and the order of introduction of the reactants (i.e., which reactants are introduced via the one or the plurality of first reactant pills 50 and which reactants are introduced via the one or the plurality of second reactant pills 60) can be reversed. For example, with reference to the previous example noted above, magnesium oxide (MgO) and/or sepiolite can be introduced as the second reactants 65 of the one or the plurality of second reactant pills 60 and magnesium sulfate heptahydrate ($MgSO_4.7H_2O$) introduced as the first reactant 55 of the one or the plurality of first reactant pills 50.

As some chemical sealants such as Sorrell cements are quickly formed when appropriate materials (i.e., reactants) are mixed in water at specific concentrations, a rapid reaction must be prevented to allow time for the materials to be in place in the loss circulation zone 10 before setting and becoming an unpumpable seal 85. The method of sealing the lost circulation zone 10 disclosed herein allows the reactants (i.e., the first reactants 55 of the one or the plurality of first reactant pills 50 and the second reactants 65 of the one or the plurality of second reactant pills 60) to be sequentially pumped downhole via the drill string 35 (not the annulus 6) as water based pills separated by an oil based spacer or pill 40A, regardless of whether the drilling fluid 8 present in the wellbore 5 when the method of sealing the lost circulation zone 10 is initiated is a water based drilling fluid 8 or an oil based drilling fluid 8. As the reactants are introduced downhole to the lost circulation zone 10 via two or more tandem pills (i.e., the first reactants 55 are introduced to the drill pipe 30 and the lost circulation zone 10 via at least one first reactant pill 50 and the second reactants 65 are introduced to the drill pipe 30 and the lost circulation zone 10 via at least one second reactant pill 60 separated from the at least one first reactant pill 50 by a spacer 40A), and the at least one first reactant pill 50 and the second reactant pill 60 can include the respective reactants in water, thus providing the water for the reaction between the first reactants 55 and the second reactants 65, it is possible to apply this technology to losses in an oil-based drilling fluid 8 as well as to losses in a water based drilling fluid 8. The tandem introduction serves to separate the reactants (i.e., to separate the first reactants 55 from the second reactants 65) until they are mixed in the wellbore 5 after exiting the drill string 35. Rather than utilizing inhibitors or multiple streams (e.g., a stream introduced via the annulus 6 and a stream introduced via the drill string 35), as conventionally done, the method of sealing the lost circulation zone 10 disclosed herein provides for introduction of a treatment via a single stream introduced via the drill string 35.

The method includes preventing mixing, within the drill string 35, of the one or the plurality of first reactants 55 of the first reactant pill(s) 50 with the one or the plurality of second reactants 65 of the second reactant pill(s) 60, in order to avoid reaction of the first reactants 55 with the second reactants 65 within drill string 35. The mixing can be prevented by appropriate selection of various parameters, including the number of first reactant pills 50, the number of second reactant pills 60, the number of spacers 40 (e.g., spacers 40A, spacers 40B, and/or spacers 40C), the volume, length, and/or rheology of each of the one or more first reactant pills 50, the volume, length, and/or rheology of each of the one or more second reactant pills 60, the volume, length, and/or rheology of the spacer 40A/40B between each first reactant pill 50 and adjacent second reactant pill 60, a pumping rate, or a combination thereof to prevent the mixing.

A mixing/channeling model can be utilized to predict or estimate the mixing and channeling expected during pumping of the first reactant pill(s) 50 and the second reactant pill(s) 60 downhole to the lost circulation zone 10, and thus select specific first reactant pills 50, second reactant pill(s) 60, spacer(s) 40 (e.g., spacers 40A/40B), and operating parameters (e.g., rates of pumping the first reactant pill(s) 50, the spacer(s) 40, and the second reactant pill(s) 60 downhole to the lost circulation zone 10). The mixing/channeling model can be utilized to calculate the appropriate length and rheology of the spacer(s) 40A between each first reactant pill 50 and subsequently introduced second reactant pill 60 and any spacer(s) 40B between each second reactant pill 60 and subsequently introduced first reactant pill 50 to prevent mixing of the reactive components (i.e., the first reactants of the first reactant pill(s) 50 and the second reactants of the second reactant pill(s) 60) at a specified (e.g., turbulent) flow rate (also referred to herein as a pumping rate).

In embodiments, downhole fluid mixing and channeling is predicted via a model. Such a model is described in International Application No. PCT/US2018/068138 filed Dec. 31, 2018, entitled Predicting Downhole Fluid Mixing and Channeling in Wellbores, the disclosure of which is hereby incorporated herein in its entirety for purposes not contrary to this disclosure. The mixing/channeling (or "displacement") model described in International Application No. PCT/US2018/068138 was developed to improve the efficiency of displacement processes where multiple tandem pills are displaced down a drill pipe. The mixing/channeling model can be adapted for the purposes disclosed herein to appropriately design the spacer(s) 40A, 40B, and/or 40C. The model can be utilized to define the length of the spacer(s) 40A/40B separating the tandem reactive pills (i.e., between each first reactant pill 50 and the following second reactant pill 60, between each second reactant pill 60 and the following first reactant pill 50, and/or) to define the length of a spacer 40C introduced prior to the 1$^{st}$ first reactant pill 50, or a spacer 40D introduced after a final first or second reactant pill 50/60 introduced during the treatment.

Such a mixing/channeling model can be utilized ahead of time to run "what-if" scenarios and allow simplified pills (e.g., first reactant pill(s) 50, second reactant pill(s) 60, and/or spacer(s) 40) to be developed that may be applicable over a range of drill fluid (e.g., mud) 8 weights.

Utilizing the mixing/channeling model to calculate the potential for mixing of the reactive components (i.e., reactants including first reactants 55 and second reactants 65) while pumping the reactants downhole via tandem pills as described herein is important, as such would result in a plugged drill pipe 30. The reactants of the reactant pills (i.e., the first reactants 55 of the one or the plurality of first reactant pills 50 and the second reactants 65 of the one or the plurality of second reactant pills 60) are designed to react with one another when contacted to create a plugging chemical mass or seal 85. Reacting of the reactants in the drill pipe 30 and subsequently plugging the drill pipe 30 would result in significant drilling lost time.

As fluids flow through the drill string 35, mixing and/or channeling between the different fluids' interfaces typically occur, generating pockets of contaminated fluids of unknown characteristics. Such mixing and/or channeling of the first reactant pill(s) 50 and the second reactant pill(s) 60 is to be prevented, via use of the spacers 40A/40B, to avoid reaction of the first reactants 55 and the second reactants and resulting plugging of the drill string 35.

Many factors affect the level of interaction of fluids at fluid interfaces, and the model utilized to select an appropriate spacer 40A/40B can take such factors into account. For example, such factors include, and without limitation, flow path geometry, including lengths, annular gaps, pipe diameters and positions (eccentricity and angle); operational conditions, including temperatures, pressures, pipe rotation, flow paths and pump schedules; fluid volumes and properties, including densities, rheologies, miscibilities, and surface tensions.

Additional aspects of the method of sealing a lost circulation zone 10 according to this disclosure will now be made with reference to FIGS. 2A-2I, which depict a wellbore servicing system III during a wellbore servicing that can include sealing a lost circulation zone 10 as described herein.

Figure 2A:
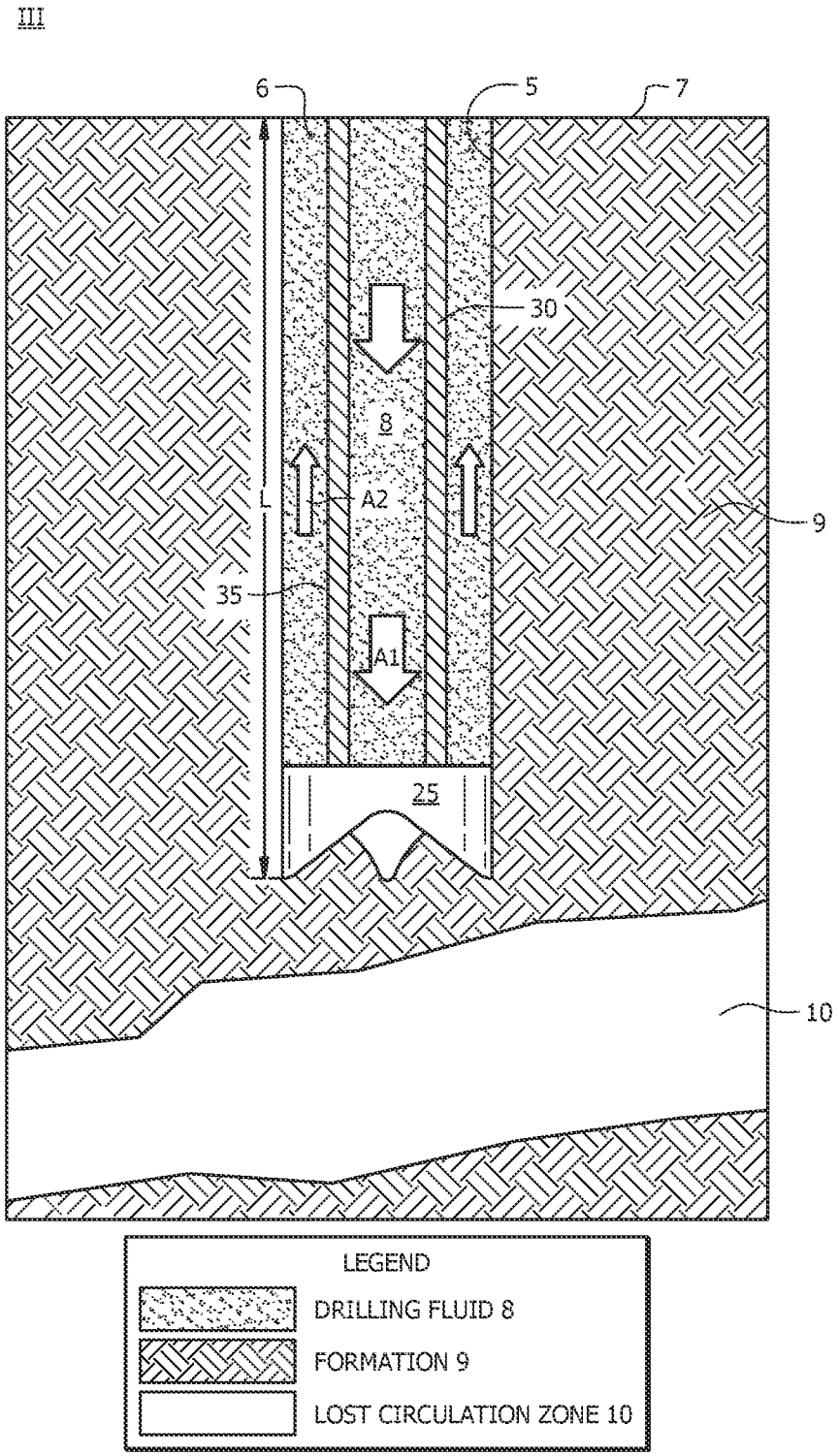
FIG. 2A depicts a wellbore servicing system prior to encountering a lost circulation zone.

FIG. 2A depicts the wellbore servicing system III prior to encountering the lost circulation zone 10. Prior to encountering the lost circulation zone 10, wellbore servicing can proceed as known in the art. For example, for a drilling operation, wellbore servicing can include drilling wellbore 5 through formation 9 via a drill string 35 including a drill bit 25 fluidly connected with a surface 7 of the formation 9 via drill pipe 30. During drilling, drilling fluid 8 can be circulated down drill string 35 in the direction indicated by arrow A1, through openings in drill bit 25, and back to surface 7 via annulus 6 in a direction indicated by arrow A2. Drill bit 25 is shown drilling through formation 9, prior to encountering lost circulation zone 10.

Figure 2B:
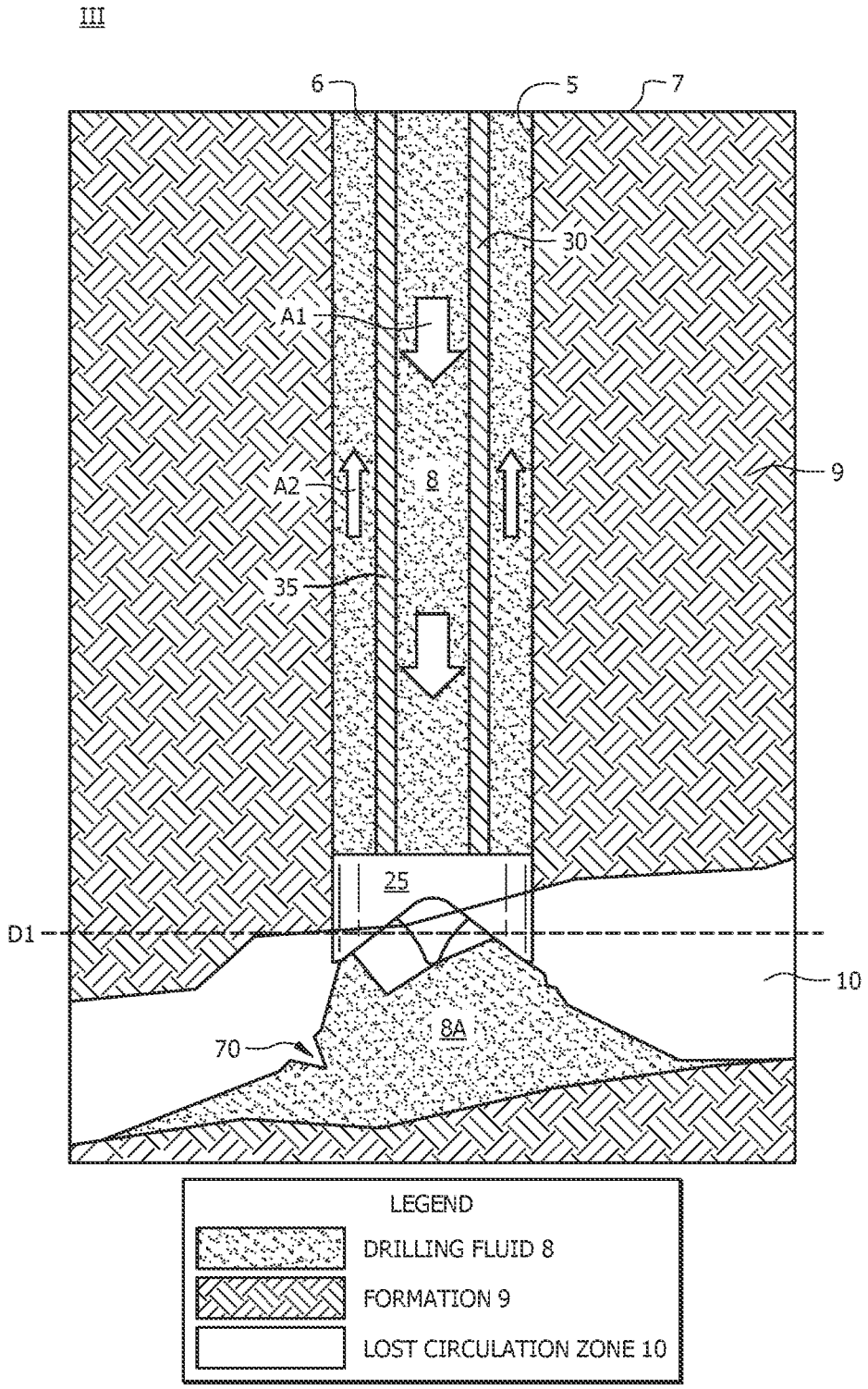
FIG. 2B depicts the wellbore servicing system of FIG. 2A upon encountering the lost circulation zone.

FIG. 2B depicts the wellbore servicing system III of FIG. 2A upon encountering the lost circulation zone 10 at a loss circulation depth D1. Upon encountering lost circulation zone 10, drilling fluid 8 can be lost to the lost circulation zone 10, rather than returning to the surface 7 via annulus 6. The lost circulation zone 10 can be, for example, a large vugular or "vug" in formation 9, which may not be treatable via conventional particulate treatments. The lost circulation zone 10 can include a one or more cavities, voids, and/or large pores in formation 9. Encountering of the lost circulation zone 10 can cause major drilling fluid losses 8A of drilling fluid 8 to the lost circulation zone 10. Although various conventional treatments (e.g., using particulates) can be attempted, some lost circulation zones 10 can include vugs and/or voids that are too large to be treated with typical loss circulation materials.

Figure 2C:
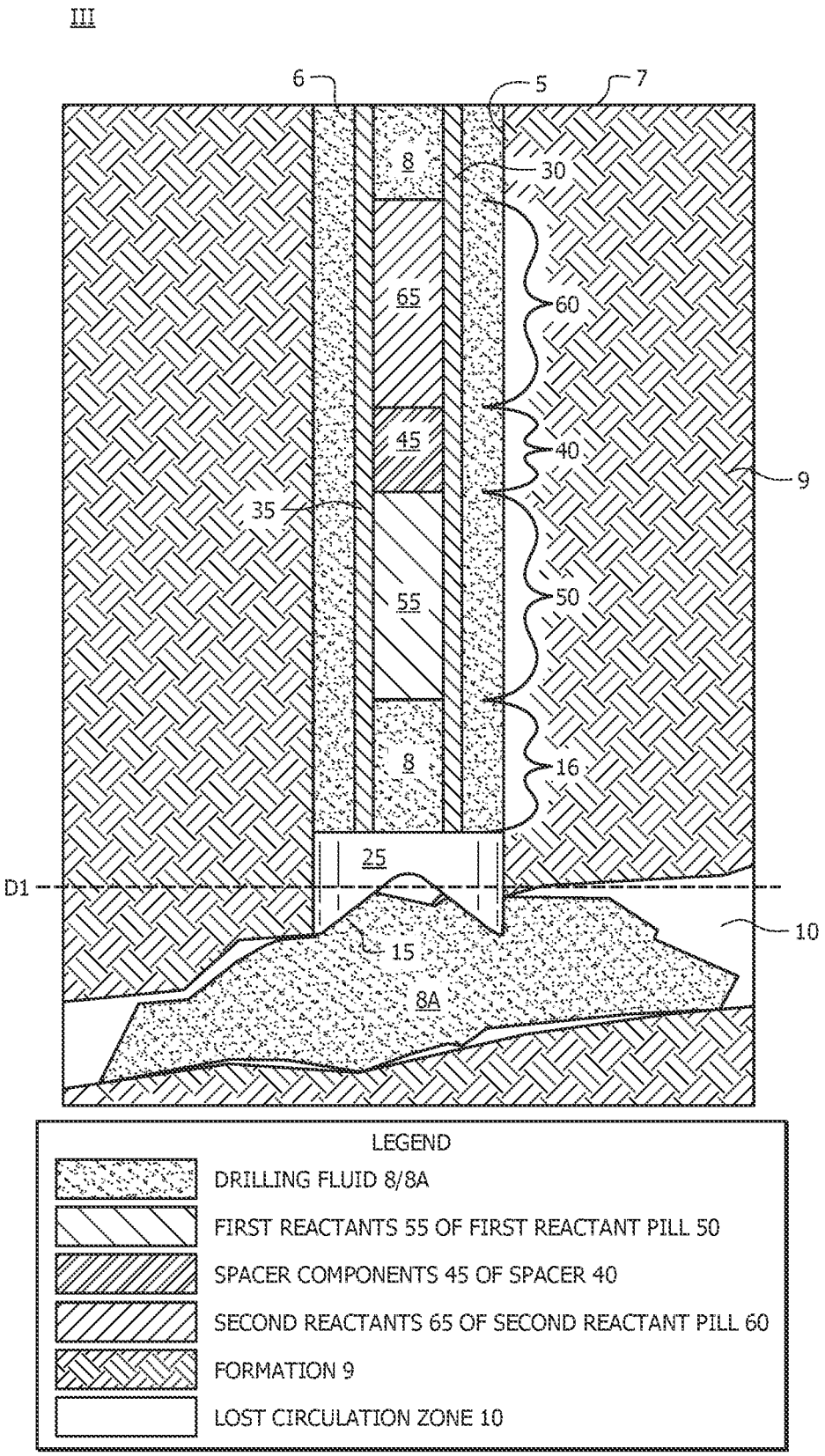
FIG. 2C depicts the wellbore servicing system of FIG. 2A after initiation of the method of sealing the lost circulation zone according to this disclosure.

FIG. 2C depicts the wellbore servicing system III of FIG. 2A after initiation of the method of sealing the lost circulation zone 10 according to this disclosure and described above with reference to FIG. 1A and FIG. 1B. At the time depicted in FIG. 2C, the first reactant pill 50, the spacer 40, and the second reactant pill 60 have been introduced into drill string 35, and have been pumped downhole until first reactant pill 50 has almost reached drill bit 25. Drilling fluid is shown remaining ahead of the (first) first reactant pill 50 and within annulus 6, as well as drilling fluid 8A lost to the lost circulation zone 10.

One or more first reactant pill(s) 50, spacer(s) 40, and second reactant pill(s) 60 can be introduced into the loss circulation zone 10 as described with reference to FIG. 1A and FIG. 1B hereinabove. In this manner, first reactants 55 and second reactants 65 can be introduced in a tandem (e.g., one after the other) via a single stream into the lost circulation zone 10. As noted hereinabove, the first reactants 55 of the first reactant pill 50 and the second reactants 65 of the second reactant pill 60 are designed to react upon mixing together to form a hard seal 85 (FIG. 2H) of lost circulation zone 10. Accordingly, a spacer 40A is introduced into the drill string 35 after introducing the first reactant pill 50 thereto and prior to introducing the second reactant pill 60 thereto in order to prevent the first reactants 55 of the first reactant pill 50 and the second reactants 65 of the second reactant pill 60 from mixing within the drill string 35 (i.e., to prevent mixing of the first reactants 55 of the first reactant pill 50 and the second reactants 65 of the second reactant pill 60 within drill pipe 30 and BHA 20 including drill bit 25). Spacer 40A (and spacer 40B, 40C, and 40D, when present) is non-reactive with either of the first reactant pill 50 and the second reactant pill 60 and is designed to not hinder the reaction of the first reactants 55 of the first reactant pill 50 and the second reactants 65 of the second reactant pill 60 after the first reactant pill 50 and the second reactant pill 60 are pumped through the drill pipe 30 and the drill bit 25 and into the lost circulation zone 10, but separates the first reactants 55 of the first reactant pill 50 and the second reactants 65 of the second reactant pill 60 while they are being pumped downhole. As described above, a plurality of first reactant pills 50 and/or a plurality of second reactant pills 60 can be utilized, with a spacer 40A introduced after introduction of each first reactant pill 50 prior to introduction of a following second reactant pill 60, and a spacer 40B introduced after introduction of each second reactant pill 50 prior to introduction of a following first reactant pill 60, and a spacer 40C can be introduced prior to introduction of the 1st first reactant pill 50 and/or a last spacer 40D introduced subsequent a final reactant pill 50/60. The required volumes and compositions of the first reactant pill(s) 50, the second reactant pill(s) 60, and/or the spacer(s) 50 (e.g., 40A, 40B, 40C, and/or 40D) can be estimated based on the observed loss rates and offset well data.

The method can include retracting the drill string 35 from the wellbore 5 while pumping one or more of the first reactant pill(s) 50, the spacers 40, or the second reactant pill(s) 60 into the wellbore 5 via the drill bit 25. Generally, a minimum distance to retract (e.g., pull up) can correspond to a hole volume created by the retraction compared to the volume of the material (e.g., the first reactant pill 50, the spacer 40, the second reactant pill 60) being pumped.

Figure 2D:
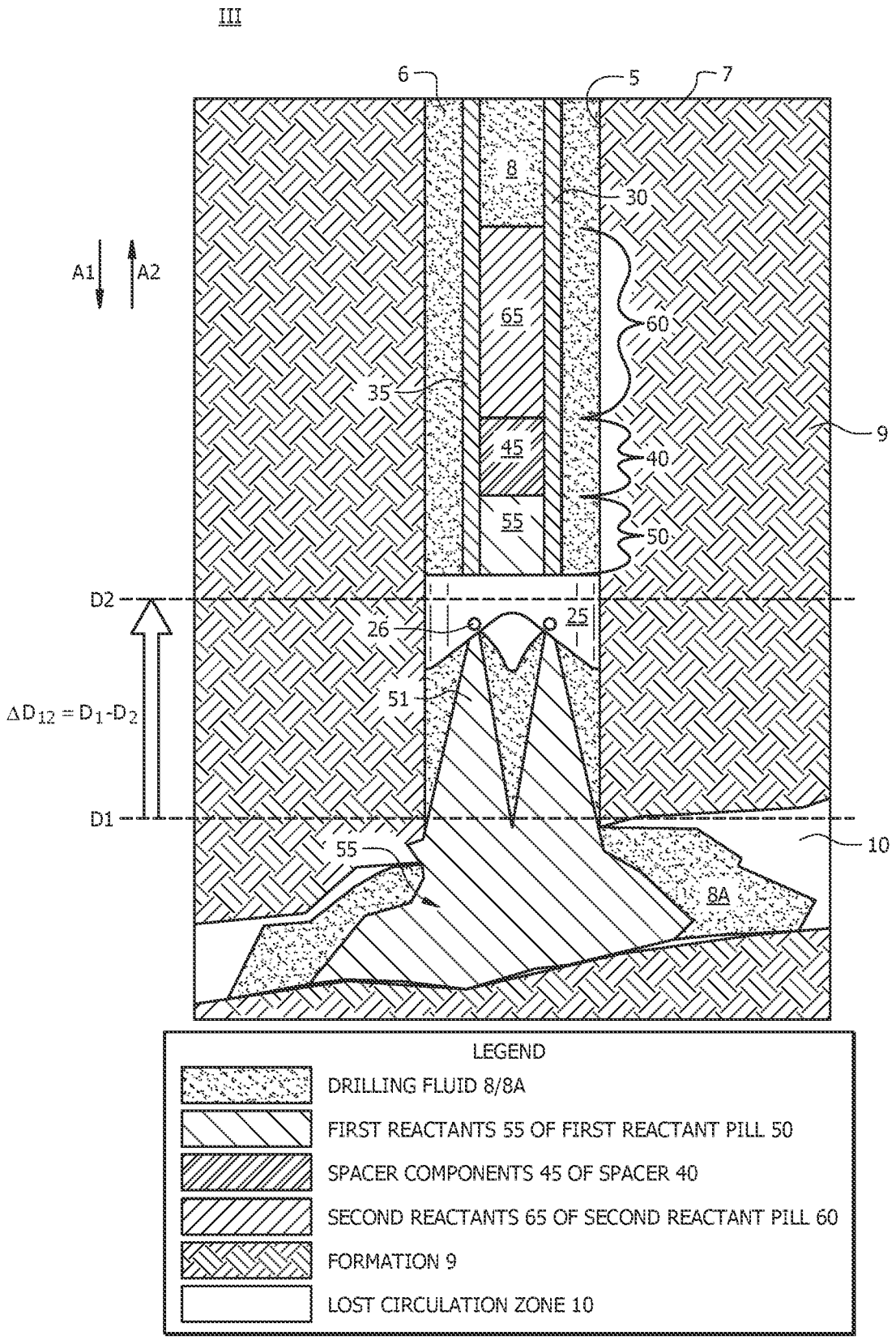
FIG. 2D depicts the wellbore servicing system of FIG. 2A during pumping of the first reactant pill into the lost circulation zone.

FIG. 2D depicts the wellbore servicing system III of FIG. 2A during pumping of the first reactant pill 50 into the lost circulation zone 10. First reactants 55 are depicted as being pumped into lost circulation zone 10 via a jetting action 51 through nozzles 26 of drill bit 25. This jetting action provided when pumping the fluids (i.e., the first reactants 55 and the second reactants 65) out of drill string 35 via the drill bit 25 can provide sufficient mixing to cause the first reactants 55 and the second reactants 65 to react and stop the drilling fluid 8A losses to the lost circulation zone 10 after jetting of the second reactants 65.

As depicted in FIG. 2D, the drill string 35 can be retracted from the wellbore 5 during pumping of the first reactant pill 50 into the lost circulation zone 10. The drill pipe 30 can be strategically retracted (e.g., pulled up) in the direction indicated by arrow A2 while the first reactants 50 are being pumped into the lost circulation zone 10, to keep the drill bit 25 above the ejected first reactants 55. For example, during pumping of the first reactants 55 from the drill string 35, drill string 35 can be retracted to a target drill string depth D2 for the first reactant pill 50, to provide a distance ΔD12 equal to the difference between D1 and D2 (i.e., ΔD12=D1−D2) between initial depth D1 and target depth D2. The retracting can be operated such that the drill string 35 is retracted, from the initial position or depth D1, a minimum distance ΔD12 that provides a retraction volume within the wellbore 5 between the drill bit 35 and the initial position or depth D1 equal to a total volume of the first reactant pill 50. The minimum distance ΔD12 can be estimated as:

$$\Delta D12=(TV_{50}*1029.4)/D^2, \quad (1)$$

wherein ΔD12 is the minimum distance (ft), $TV_{50}$ is the total volume (US barrels) of the first reactant pill, and D is an inside diameter of the wellbore 5 (in).

The retracting of the drill string 35 from initial position or depth D1 to target depth D2 can be effected at a speed such that a hole volume created by the retracting of the drill string 35 is greater than or equal to the volume of the first reactant pill 50 being ejected from the drill string 35 into the wellbore 5 via the drill bit 25.

The retraction speed can be approximated as $$S\ (\text{ft/min})=24.511*Q/D^2, \quad (2)$$

wherein S is the speed (ft/min), Q is a pumping flow rate (US gal/min), and D is an inside diameter of the wellbore (in). The pumping flow rate may be turbulent.

Figure 2E:
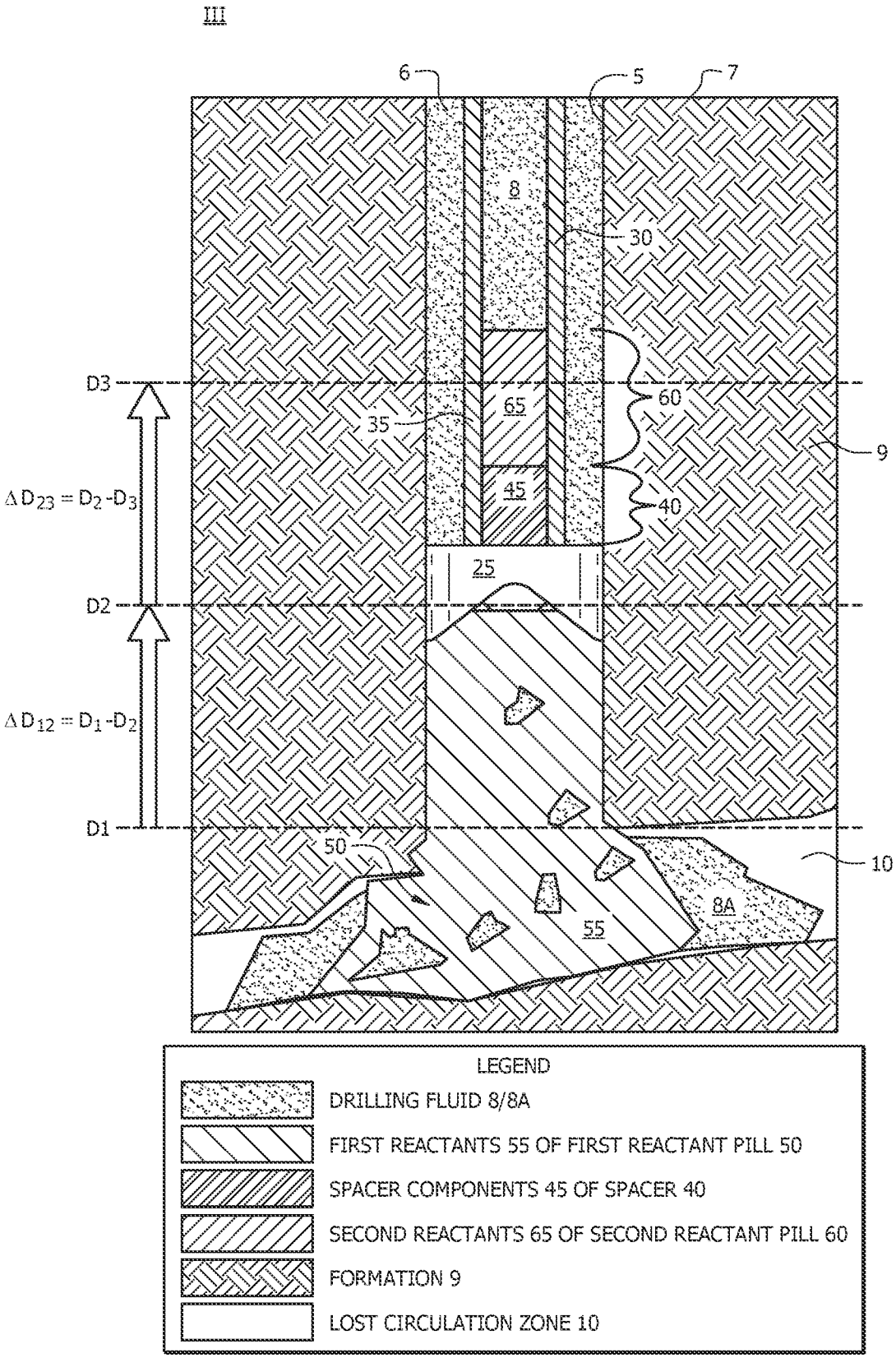
FIG. 2E depicts the wellbore servicing system of FIG. 2A upon completion of pumping of one or a plurality of first reactants of a first reactant pill into the wellbore, when the drill bit is at least a minimum distance ΔD12 from an initial position or depth D1.

FIG. 2E depicts the wellbore servicing system III of FIG. 2A upon completion of pumping of the first reactants 55 of first reactant pill 50 into wellbore 5, when drill bit 25 is at least the minimum distance ΔD12 from initial position or depth D1. During pumping of spacer 40 and second reactant pill 60 from drill string 35, drill string 35 can be retracted at least a minimum distance ΔD23 to a target drill string depth D3 for the second reactant pill 60. In the depiction of FIG. 2E, spacer 40 and second reactant pill 60 remain within the drill string 35. The spacer and second reactant pill 60 will next be jetted 61 through the drill bit 25 to intimately mix with the first reactants 55 within the wellbore 5.

The minimum distance ΔD23 can be estimated as:

$$\Delta D23=(TV_{40/60}*1029.4)/D^2, \quad (3)$$

wherein ΔD23 is the minimum distance (ft), $TV_{40/60}$ is the total volume (US barrels) of the second reactant pill 60 and the spacer 40A that was introduced into drill string 35 between the introduction of the first reactant pill 50 and the introduction of the second reactant pill 60 into drill string 35, and D is an inside diameter of the wellbore 5 (in). It is to be understood that, due to mixing during travel downhole, the interfaces between the first reactant pill 50, the spacer 40, and the second reactant pill 60 will not be clearly delineated, as depicted in FIGS. 2A-2E.

The retracting of the drill string 35 from target depth D2 to target depth D3 can again be effected at a speed such that a hole volume created by the retracting of the drill string 35 is greater than or equal to the volume of fluid (e.g., spacer components 45 of spacer 40A and second reactants 65 of second reactant pill 60) being ejected from the drill string 35 into the wellbore 5 via the drill bit 25. The retraction speed during retraction from target depth D2 to target depth D3 can again be approximated as per Equation (2).

Figure 2F:
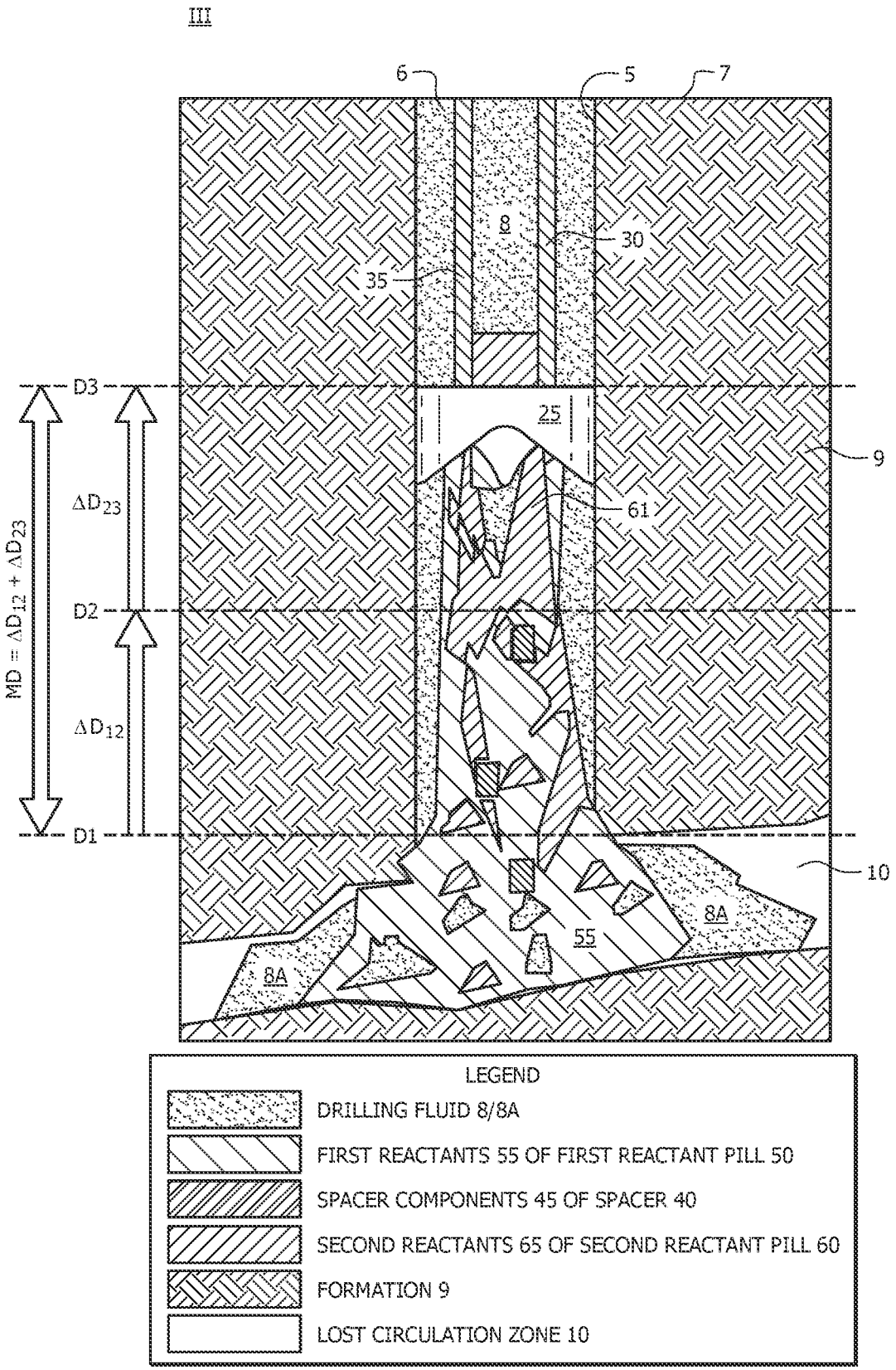
FIG. 2F depicts the wellbore servicing system of FIG. 2A during completion of pumping of one or a plurality of second reactants of a second reactant pill into the wellbore, when the drill bit is at least a minimum distance MD equal to ΔD12+ΔD23 from the initial position or depth D1.

FIG. 2F depicts the wellbore servicing system III of FIG. 2A during completion of pumping of the second reactants 55 of second reactant pill 60 into wellbore 5, when drill bit 25 is at least a minimum distance MD equal to ΔD12+ΔD23 from initial position or depth D1.

Overall, during pumping of the first reactant pill 50, the spacer 40, and the second reactant pill 60 into the wellbore 5, drill string 35 can be retracted from initial position or depth D1 a minimum distance MD according to Equation (3):

$$MD=(TV*1029.4)/D^2, \quad (4)$$

wherein MD is the minimum distance (ft), TV is the total volume (US barrels) of the first reactant pill 50, the spacer 40, and the second reactant pill 60, and D is the inside diameter of the wellbore (in) 5. As noted above, the retracting of the drill string 35 during the pumping of the first reactant pill 50, the spacer 40, and/or the second reactant pill 60 can be effected at a speed such that the hole volume created by the retracting of the drill string 35 is greater than or equal to the volume being ejected from the drill string 35 into the wellbore 5 via the drill bit 25, and can be estimated by Eq. (2).

These equations can be broadened to include any number of first reactant pills 50, spacers 40, and second reactant pills 60. For example, the minimum distance ("Distance" in Equation (5); ft) that the pipe should be pulled may be calculated by Equation (5):

$$\text{Distance} = \frac{\sum_{1}^{n} PillVolume_i * 1029.4}{HoleD^2}\ \text{ft} \tag{5}$$

wherein Pill Volume$_i$ is the total volume for n pills in bbl (US Petroleum), n is the number of pills (the Pill Volume may include a free surface volume for mud cap 8C described with reference to FIG. 2H hereinbelow).

The jetting action 61 of the second reactants 65 of the second reactant pill 60 into the first reactants 55 within the wellbore 5 will intimately mix the first reactants 55 and the second reactants, such that reaction thereof (e.g., hardening thereof) can occur to form a seal 85 that can prevent the lost circulation. The drill string can be maintained at the second target depth D3 until sufficient reaction time has elapsed for the materials to harden. The drill string 35 can be maintained at target depth D3 or a distance farther from initial position or depth D1 while allowing the one or the plurality of first reactants 55 to react, within the lost circulation zone 10, with the one or the plurality of second reactants 65 for a reaction time to provide a seal 85 of the lost circulation zone 10.

Figure 2G:
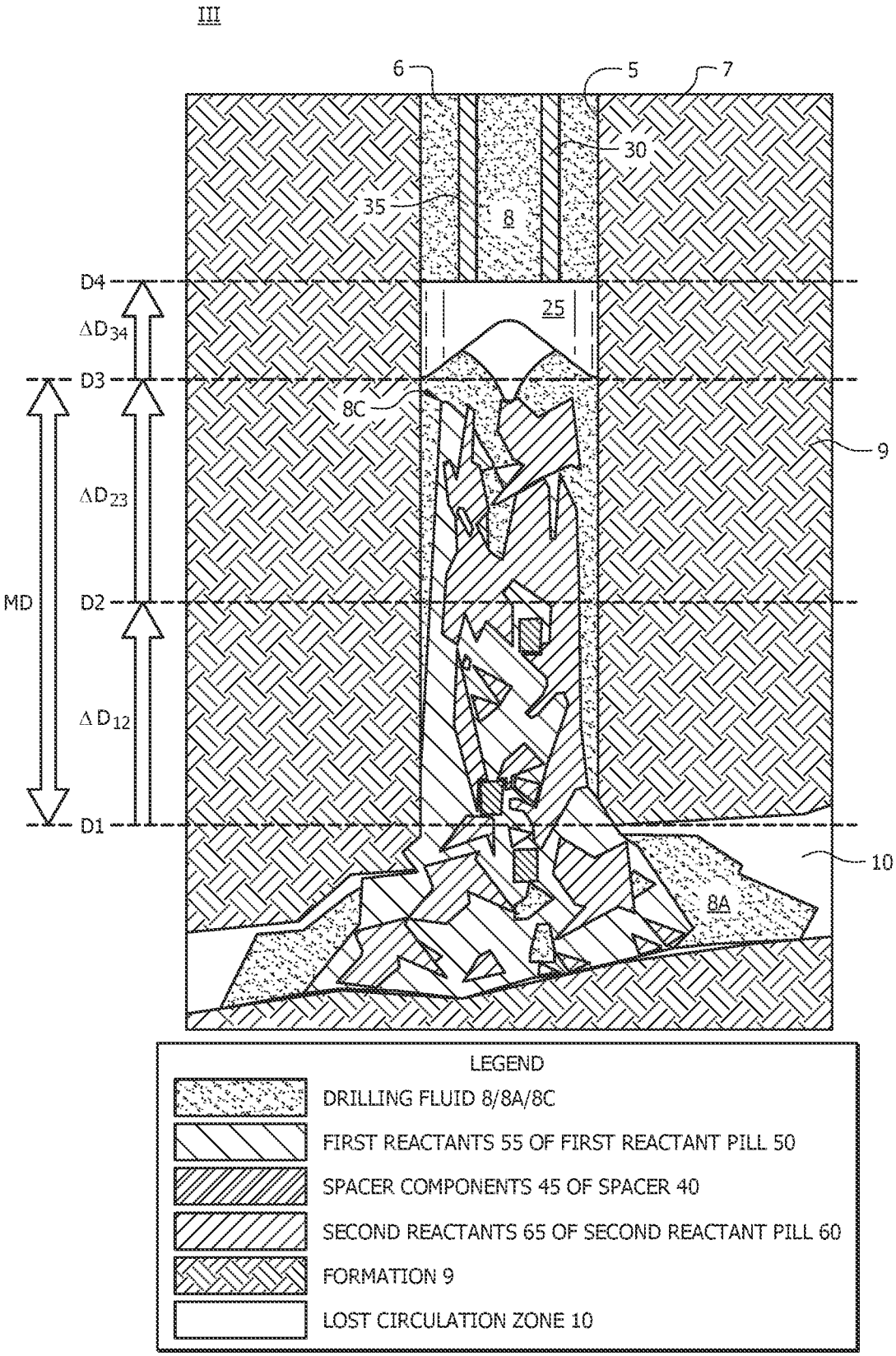
FIG. 2G depicts the wellbore servicing system of FIG. 2A subsequent introduction of the second reactant pill into the wellbore.

As depicted in FIG. 2G, which depicts the wellbore servicing system III of FIG. 2A subsequent introduction of second reactant pill 60 into wellbore 5, in aspects, the drill string 35 can be retracted, while pumping additional drilling fluid 8C, to a depth D4 a further distance ΔD34 beyond the minimum distance MD above the loss circulation zone 10 once all reactive components (e.g., all first reactants 55 and second reactants 65) are displaced into the open hole. This can provide a margin of error and ensure that the reactants (i.e., the one or the plurality of first reactants 55 and the one or the plurality of second reactants 65) do not react within the drill string 35 (e.g., do not react within or while contacting drill bit 25). The additional drilling fluid 8C or "mud cap" deposited between target depth D3 and depth D4 can serve to ensure that the drill string 35 is completely removed from the location of the reactants. The first reactants 55 and the second reactants 65 are intimately mixed within the lost circulation zone 10.

Figure 2H:
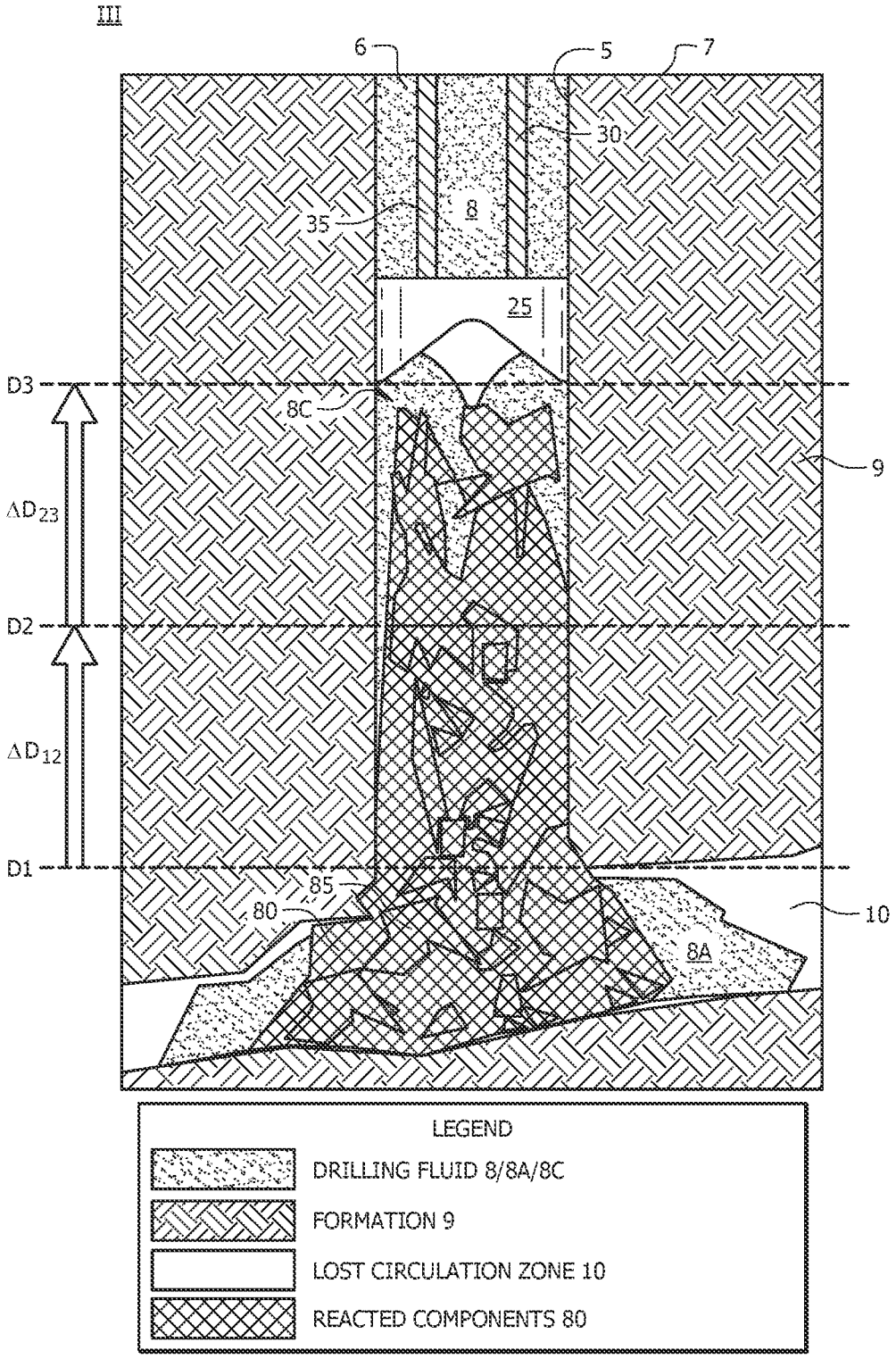
FIG. 2H depicts the wellbore servicing system of FIG. 2A after reaction of the one or the plurality of first reactants with the one or the plurality of second reactants to produce reacted components that provide a seal of the lost circulation zone.

FIG. 2H depicts the wellbore servicing system III of FIG. 2A after reaction of the one or the plurality of first reactants 55 with the one or the plurality of second reactants 65 to reacted components 80. The reacted components 80 provide the seal 85 of the lost circulation zone 10.

Figure 2I:
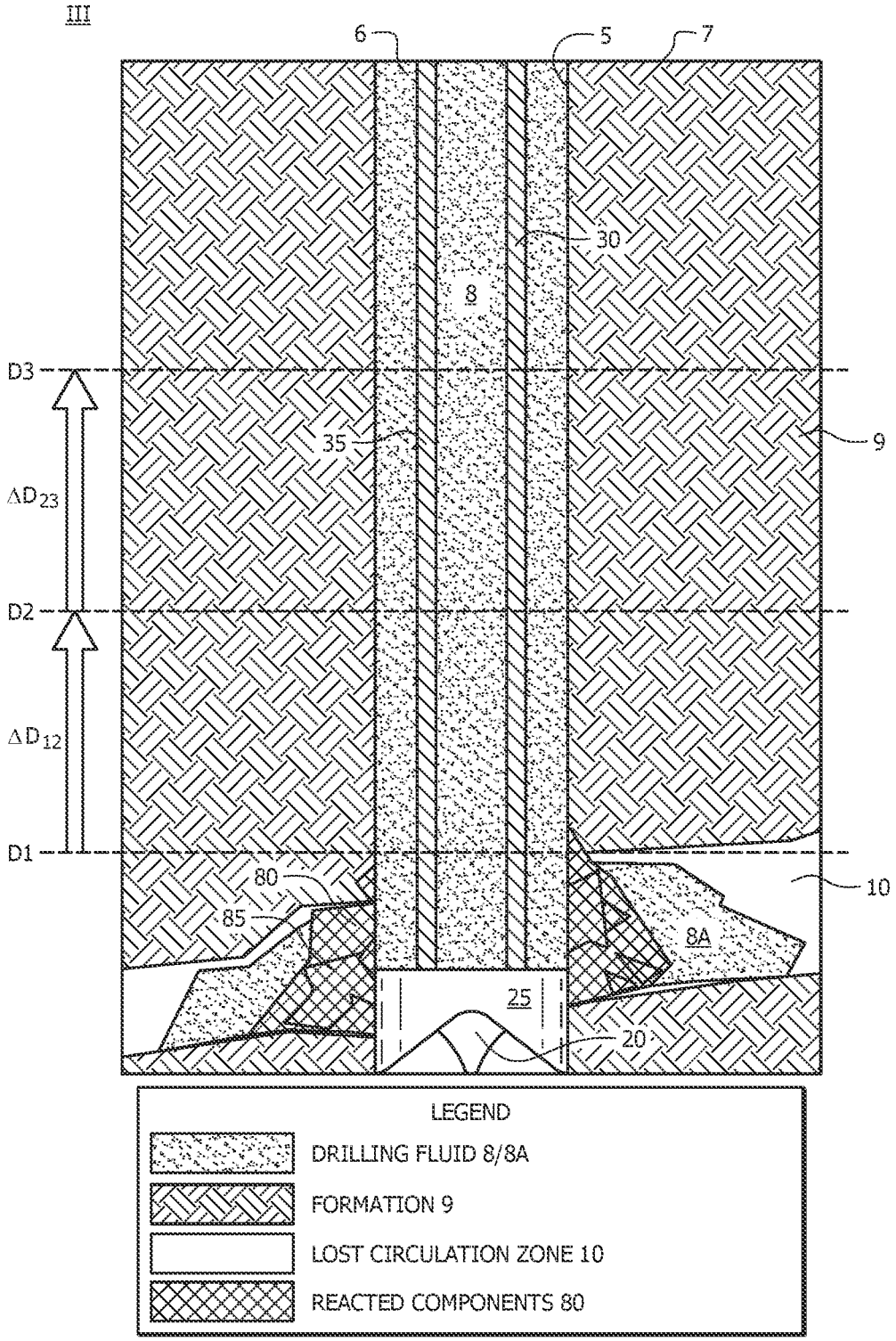
FIG. 2I depicts the wellbore servicing system of FIG. 2A after drilling through the seal of the lost circulation zone.

The method of sealing the lost circulation zone 10 can further include drilling through the seal 85 and continuing the drilling operation. FIG. 2I depicts the wellbore servicing system III of FIG. 2A after drilling through the seal of the lost circulation zone 10. The remaining seal 85 prevents loss of drilling fluid 8 into the now sealed lost circulation zone 10. Optional additional drilling fluid or mud cap 8C is depicted in FIG. 2H above the reacted components 80.

In aspects, a method of sealing a lost circulation zone 10 encountered during a drilling operation includes: positioning a bottom hole assembly (BHA) 20 of a drill string 35 at an initial position D1 proximate a lost circulation zone 10 in a wellbore 5, wherein the BHA 20 includes a drill bit 25 fluidly connected with a surface 7 of the wellbore via a drill pipe 30; pumping a first reactant pill 50 through nozzles 26 of the drill bit 25 while retracting the drill string 35 from the initial position D1 to a second position D2 within the wellbore 5, wherein the first reactant pill 50 includes one or a plurality of first reactants 55, and wherein the second position D2 is closer, along a length of the wellbore 5, to the surface 7 than the initial position D1; pumping a second reactant pill 60 through the nozzles 26 of the drill bit 25 while retracting the drill string 35 from the second position D2 to a third position D3 within the wellbore 5, wherein the second reactant pill 60 includes one or a plurality of second reactants 65, whereby the one or the plurality of second reactants 65 are mixed with the one or the plurality of first reactants 55, and wherein the third position D3 is closer, along a length L of the wellbore 5, to the surface 7 than the second position D2; and allowing the one or the plurality of first reactants 55 to react, within the lost circulation zone 10, with the one or the plurality of second reactants 65 for a reaction time to provide a seal 85 of the lost circulation zone 10. The method can further include: drilling through the seal 85 and continuing the drilling operation.

As described hereinabove, the method can further include preventing mixing, within the drill string 35, of the one or the plurality of first reactants 55 of the first reactant pill 50 with the one or the plurality of second reactants 65 of the second reactant pill 60 by introducing a spacer 40A into the drill string 35 between introducing the first reactant pill 50 into the drill string 35 and introducing the second reactant pill 60 into the drill string 35, wherein the spacer 40A is not reactive with the one or the plurality of first reactants 55 of the first reactant pill 50 or with the one or the plurality of second reactants 65 of the second reactant pill 60.

As described hereinabove with reference to FIG. 1A, the drilling operation can employ a water based drilling fluid 8, such that, prior to introducing the first reactant pill 50 into the drill string 35, the drill string 35 contains a water based drilling fluid 8. In such applications, the first reactant pill 50, the second reactant pill 60, or both the first reactant pill 50 and the second reactant pill 60 can be water based pills, and the spacer 40A can include an oil-based spacer 40A. An oil based spacer 40C can be introduced into the drill string 35 prior to the introducing of the first reactant pill 50 into the drill string 35. The spacer 40C introduced into the drill string 35 prior to the first reactant pill 50 can be the same as or different from the spacer 40A introduced into the drill string 35 subsequent introduction of the first reactant pill 50 thereto and prior to introduction of the second reactant pill 60 thereto. A spacer 40B introduced into the drill string 35 subsequent introduction of a second reactant pill 60 thereto can be the same as or different from the spacer 40A introduced into the drill string 35 subsequent introduction of the first reactant pill 50 thereto and prior to introduction of the second reactant pill 60 thereto, a spacer 40C introduced into the drill string 35 prior to introduction thereto of the 1$^{st}$ first reactant pill 50, and/or a spacer 40D introduced into the drill string 35 subsequent introduction thereto of a final reactant pill 50 or 60. In applications, spacer(s) 40A, 40B, 40C, and/or 40D have the same composition (e.g., include the same fluid).

As described hereinabove with reference to FIG. 1B, the drilling operation can employ an oil based drilling fluid 8, such that, prior to introducing the first reactant pill 50 into the drill string 35, the drill string 35 contains an oil based drilling fluid 8. In such applications, the first reactant pill 50 and the second reactant pill 60 can be water based pills, and the spacer 40A can include the oil based drilling fluid 8.

As described hereinabove with reference to FIGS. 2A-2I, the retracting of the drill string 35 from the wellbore 5 can be operated such that the third position or depth D3 provides a retraction volume within the wellbore 5 between the drill bit 25 and the initial position D1 greater than or equal to a total volume of the first reactant pill 50, the spacer 40, and the second reactant pill 60. The retracting of the drill string 35 can be effected at a speed such that a hole volume created by the retracting of the drill string 35 is greater than or equal to a volume of fluid (e.g., first reactant pill 50, spacer 40A, second reactant pill 60) being ejected from the drill string 35 via the drill bit 25. The retraction speed can be estimated, for example via Equation (2) hereinabove.

The method can further include preventing mixing, within the drill string 35, of the one or the plurality of first reactants 55 of the first reactant pill 50 with the one or the plurality of second reactants 65 of the second reactant pill 60 by selecting a length, a volume, a density, an operating parameter, such as a pumping rate, and/or a rheology (e.g., viscosity, yield point, etc.) of the spacer 40A to prevent the mixing. A model can be utilized to predict mixing and/or channeling of the first reactant pill(s) 50 and the second reactant pill(s) 60 to select the length and/or rheology of the spacer(s) 40A, 40B, 40C, and/or 40D.

A volume of the first reactant pill 50, a volume of the second reactant pill 60, a pumping rate, or a combination thereof can be selected to provide sufficient mixing, in the lost circulation zone 10, of the one or the plurality of first reactants 55 of the first reactant pill 50 with the one or the plurality of second reactants 65 of the second reactant pill 60, such that the one or the plurality of first reactants 55 and the one or the plurality of second reactants 65 react to produce a seal 85 of the lost circulation zone 10.

As detailed hereinabove, the method can include pumping a plurality of first reactant pills 50, a plurality of second reactant pills 60, or both a plurality of first reactant pills 50 and a plurality of second reactant pills 60 into the lost circulation zone 10. The plurality of first reactant pills 50, other than a 1$^{st}$ of the plurality of first reactant pills 50 introduced into the drill string 25, is introduced into the drill string 35 subsequent introducing into the drill string 35 of a second reactant pill 60 followed by introducing into the drill string 35 of a spacer 40B, and each of the plurality of second reactant pills 60 is introduced into the drill string 35 subsequent introducing into the drill string 35 of a first reactant pill 50 followed by introducing into the drill string 35 of an (e.g., oil based) spacer 40A.

Those of ordinary skill in the art will readily appreciate various benefits that may be realized by the present disclosure. The herein disclosed method provides a method for sealing a lost circulation zone 10 that provides for curing a lost circulation zone 10 issue in the presence of an oil based drilling fluid 8 (e.g., an oil based mud (OBM)) or a water based drilling fluid 8 (e.g., a water based mud).

The disclosed method of sealing a lost circulation zone 10 allows for pumping all the reactive components (i.e., all the first reactants 55 of the first reactant pill(s) and all the second reactants 65 of the second reactant pill(s) 60) down the drill pipe 30 via a single stream of tandem reactive pills. This allows the treatments for lost circulation to be used any time, including in well control situations where preventers are closed, as none of the reactants need to be pumped to the lost circulation zone 10 via the annulus 6. The spacer(s) 40A between each first reactant pill 50 and each subsequent second reactant pill 60 and spacer(s) 40B between each second reactant pill 60 and any subsequent first reactant pill 50 act to prevent mixing of the first reactants 55 of the one or the plurality of first reactant pills 50 with the second reactants 65 of the one or the plurality of second reactant pills 60 (i.e., prevent mixing of first reactants 55 of a first reactant pill 50 with the second reactants 65 of a following or preceding second reactant pill 60). The risk of having the tandem pills mix (and thus having the reactants react) in the drill pipe 30 during passage through the drill string 35 can be reduced or eliminated by utilizing a mixing/channeling model as described herein.

In aspects, the disclosed method of sealing a lost circulation zone 10 allow for cheaper and more abundant reactants (e.g., Epsom salts, $MgSO_4.7H_2O$) to be utilized in place of more expensive reactants (e.g., $MgCl_2.6H_2O$).

Aspects of the herein disclosed method of sealing a lost circulation zone 10 provide for utilization of the jetting action of the nozzles 26 of the drill bit 25 to mix fluids downhole. The position of the drill string 35 is considered and controlled while applying the chemical treatment (i.e., while introducing the one or the plurality of first reactant pills 50 and the one or the plurality of second reactant pills 60) into the wellbore 5 at or adjacent the lost circulation zone 10. The initial position or depth D1 of the drill string 35 relative to the lost circulation zone 10 and the speed of retracting the drill string 35 from the wellbore 5 and the pumping speed at which the treatment is pumped into the wellbore 5 can be controlled as described herein to control (e.g., to maximize) mixing efficiency and mitigating risk.

Examples

The embodiments having been generally described, the following examples are given as particular embodiments of the disclosure and to demonstrate the practice and advantages thereof. It is understood that the examples are given by way of illustration and are not intended to limit the specification or the claims in any manner.

Example

Figure 3A:
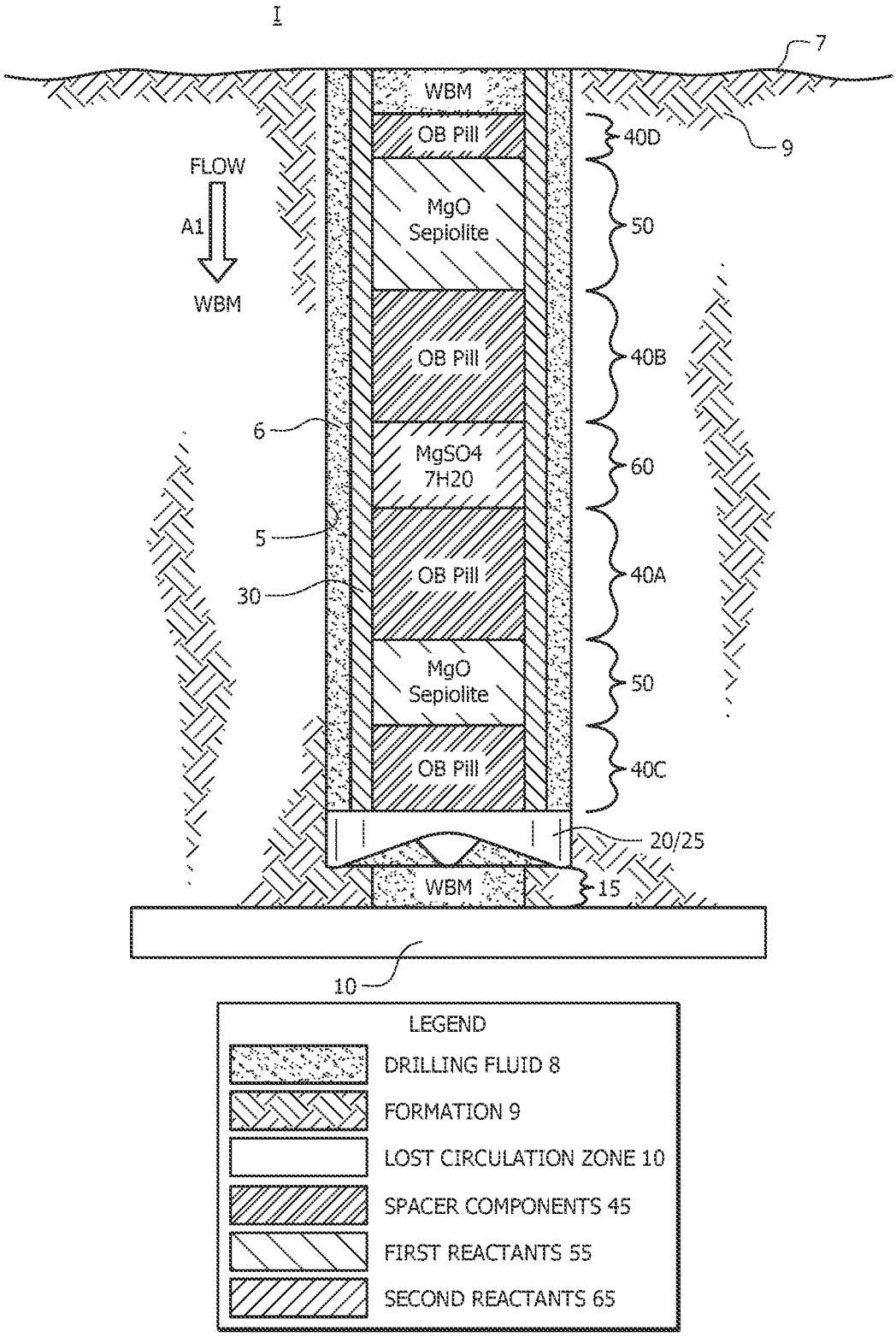
FIG. 3A is a schematic of the wellbore servicing system of FIG. 1A in which a method of sealing a lost circulation zone according to this disclosure has been initiated with specific reactants, as described in the Example.
Figure 3B:
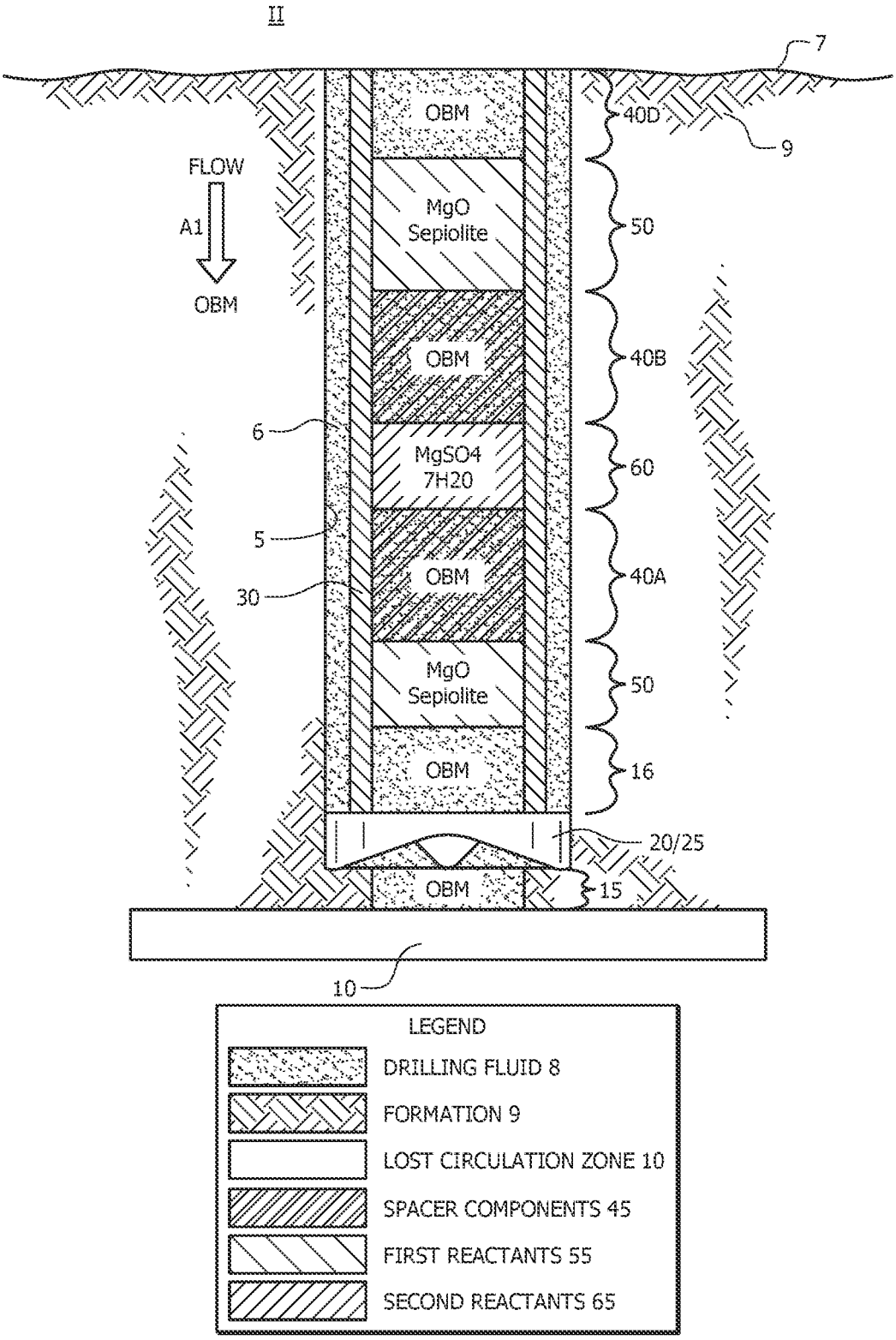
FIG. 3B is a schematic of the wellbore servicing system of FIG. 1B in which a method of sealing a lost circulation zone according to this disclosure has been initiated has been initiated with specific reactants, as described in the Example.

Example of Pill Concentrations and Relative Position in the Drill Pipe. This Example provides exemplary pill compositions for methods utilizing three reactant pills, such as depicted in FIG. 3A and FIG. 3B. In this Example, the first reactants 55 of two first reactant pills 50 (i.e., a 1$^{st}$ first reactant pill 50 and a 2$^{nd}$ first reactant pill 50) include magnesium oxide (MgO) and attapulgite clay; and the second reactants of the single second reactant pill 60 introduced subsequent the 1$^{st}$ first reactant pill 50 and prior to the 2$^{nd}$ first reactant pill 50 includes magnesium sulfate heptahydrate (Epsom salt). Such three reactant Exemplary relative concentrations for one barrel treatment are provided in Table 1.

TABLE 1

Exemplary Pill Compositions for One Barrel of Treatment

| PILLS | 1$^{st}$ First Reactant Pill 50 | Second Reactant Pill 60 | 2$^{nd}$ First Reactant Pill 50 | Total |
|---|---|---|---|---|
| Water (gal) | 8.05 | 16.97 | 8.05 | 33.08 |
| MgO (pounds (lb)) | 50 | | 50 | 100 |
| $MgSO_4 \cdot 7H_2O$ (lb) | | 67.69 | | 67.69 |
| Zeolite (lb) | 12.31 | | 12.31 | 24.62 |

An alternative formulation is provided in Table 2.

TABLE 2

Alternative Pill Compositions for One Barrel of Treatment

| PILLS | 1st First Reactant Pill 50 | Second Reactant Pill 60 | 2nd First Reactant Pill 50 | Total |
|---|---|---|---|---|
| Water (gal) | 11.0 | 11.0 | 11.0 | 33.00 |
| MgO (pounds (lb)) | 35 | | 35 | 70 |
| $MgSO_4 \cdot 7H_2O$ (lb) | | 48 | | 48 |
| Zeogel (g) | 26 | | 26 | 52 |

Treatment volumes can generally be in the range of from about 10 to about 50 barrels. The concentration of the MgO can be in the range of from about 35 to about 50 parts per barrel (ppb). The concentration of the zeolite can be in the range of from about 12 to about 26 ppb. The concentration of the $MgSO_4.7H_2O$ can be in the range of from about 48 to about 68 ppb. The concentrations of the first reactants 55 and the second reactants 65 in each of the individual pills can be varied, since it is the total concentration of the mixed reactant components introduced into the lost circulation zone 10 that is important to forming the seal 85. Although three reactant pills are shown in this Example 1, two water based first reactant pills 50 (i.e., a 1st first reactant pill 50 and a 2nd first reactant pill 50) containing the MgO, and one water based second reactant pill 60 (i.e., second reactant pill 60) including the $MgSO_4.7H_2O$, any number of first reactant pills 50 and second reactant pills 60 can be utilized, as detailed hereinabove. Furthermore, in alternative aspects, one or a plurality of first reactant pills 50 can include the $MgSO_4.7H_2O$, and one or a plurality of second reactant pills 60 can include the MgO.

ADDITIONAL DISCLOSURE

The following are non-limiting, specific embodiments in accordance with the present disclosure:

In a first embodiment, a method of sealing a lost circulation zone during a drilling operation comprises: positioning a bottom hole assembly (BHA) at an initial position proximate a lost circulation zone in a wellbore, wherein the BHA includes a drill bit fluidly connected with a surface of the wellbore via a drill string; and pumping a first reactant pill, a spacer, and a second reactant pill into the lost circulation zone via the drill string and the drill bit, wherein the first reactant pill includes one or a plurality of first reactants, wherein the second reactant pill includes one or a plurality of second reactants, wherein the spacer is not reactive with the one or the plurality of first reactants or with the one or the plurality of second reactants, wherein the first reactant pill is pumped into the lost circulation zone prior to pumping of the second reactant pill into the lost circulation zone due to introducing of the spacer into the drill string between introducing into the drill string of the first reactant pill and introducing into the drill string of the second reactant pill, and wherein, after a reaction time, reactants comprising the one or the plurality of first reactants of the first reactant pill and the one or the plurality of second reactants of the second reactant pill react within and provide a seal of the lost circulation zone.

In a second embodiment, a method of sealing a lost circulation zone during a drilling operation comprises: positioning a bottom hole assembly (BHA) at an initial position proximate a lost circulation zone in a wellbore, wherein the BHA includes a drill bit fluidly connected with a surface of the wellbore via a drill string; pumping a first reactant pill, a spacer, and a second reactant pill into the lost circulation zone via the drill string and the drill bit, wherein the first reactant pill includes one or a plurality of first reactants, wherein the second reactant pill includes one or a plurality of second reactants, wherein the spacer is not reactive with the one or the plurality of first reactants or with the one or the plurality of second reactants, wherein, after a reaction time, reactants comprising the one or the plurality of first reactants of the first reactant pill and the one or the plurality of second reactants of the second reactant pill react within and provide a seal of the lost circulation zone.

A third embodiment can include the method of any one of the first or second embodiment, further comprising: drilling through the seal and continuing the drilling operation.

A fourth embodiment can include the method of any one of the first to third embodiments, wherein, prior to the pumping of the first reactant pill, the spacer, and the second reactant pill into the lost circulation zone, the wellbore contains a water based drilling fluid, wherein the first reactant pill, the second reactant pill, or both the first reactant pill and the second reactant pill are water based pills, and wherein the spacer is an oil-based spacer.

A fifth embodiment can include the method of any one of the first to fourth embodiments, further comprising introducing an oil based pill into the drill string prior to the introducing of the first reactant pill into the drill string.

A sixth embodiment can include the method of any one of the first to fifth embodiments, wherein, prior to pumping the first reactant pill, the spacer, and the second reactant pill into the lost circulation zone, the wellbore contains an oil based drilling fluid, wherein the first reactant pill and the second reactant pill are water based pills, and wherein the spacer includes the oil based drilling fluid.

A seventh embodiment can include the method of any one of the first to sixth embodiments, comprising pumping a plurality of first reactant pills, a plurality of second reactant pills, or both a plurality of first reactant pills and a plurality of second reactant pills into the lost circulation zone, wherein each of the plurality of first reactant pills, other than a first of the plurality of first reactant pills introduced into the drill string, is introduced into the drill string subsequent introducing into the drill string of a second reactant pill followed by introducing into the drill string of a spacer, and wherein each of the plurality of second reactant pills is introduced into the drill string subsequent introducing into the drill string of a first reactant pill followed by introducing into the drill string of a spacer.

An eighth embodiment can include the method of the seventh embodiment, wherein the plurality of first reactant pills include from 2 to about 10 first reactant pills, wherein the plurality of second reactant pills include from 2 to about 10 second reactant pills, or wherein the plurality of first reactant pills include from 2 to about 10 first reactant pills and the plurality of second reactant pills include from 2 to about 10 second reactant pills.

A ninth embodiment can include the method of the seventh embodiment, further comprising tailoring a number of first reactant pills in the plurality of first reactant pills and/or a volume of the first reactant pill or of each of the first reactant pills of the plurality of first reactant pills, a number of second reactant pills in the plurality of second reactant pills and/or a volume of the second reactant pill or of each of the second reactant pills of the plurality of second reactant pills, or a combination thereof to optimize mixing of the reactants in the lost circulation zone.

A tenth embodiment can include the method of any one of the first to ninth embodiments, further comprising retracting the drill string from the wellbore while pumping one or more of the first reactant pill, the spacer, or the second reactant pill into the wellbore via the drill bit.

An eleventh embodiment can include the method of the tenth embodiment, wherein retracting of the drill string is effected at a speed such that a hole volume created by the retracting of the drill string is greater than or equal to a volume being ejected from the drill string into the wellbore via the drill bit.

A twelfth embodiment can include the method of the eleventh embodiment, wherein the speed is such that: S (ft/min)=24.511*Q/$D^2$, wherein S is the speed (ft/min), Q is a pumping flow rate (US gal/min), and D is an inside diameter of the wellbore (in).

A thirteenth embodiment can include the method of any one of the eleventh or twelfth embodiments, wherein the retracting is operated such that the drill string is retracted, from the initial position, a minimum distance that provides a retraction volume within the wellbore between the drill bit and the initial position equal to a total volume of the first reactant pill, the spacer, and the second reactant pill during the pumping of the first reactant pill, the spacer, and the second reactant pill into the lost circulation zone.

A fourteenth embodiment can include the method of the thirteenth embodiment, wherein the minimum distance is: MD=(TV*1029.4)/$D^2$, wherein MD is the minimum distance (ft), TV is the total volume (US barrels) of the first reactant pill, the spacer, and the second reactant pill, and D is an inside diameter of the wellbore (in).

A fifteenth embodiment can include the method of any one of the first to fourteenth embodiments, further comprising preventing mixing, within the drill string, of the one or the plurality of first reactants of the first reactant pill with the one or the plurality of second reactants of the second reactant pill by selecting a length, a volume, a density, a pumping rate, and/or a rheological parameter of the spacer to prevent the mixing.

A sixteenth embodiment can include the method of the fifteenth embodiment, further comprising utilizing a model to select the length, the volume, the density, the pumping rate, and/or the rheological parameter of the spacer.

A seventeenth embodiment can include the method of any one of the first to sixteenth embodiments, further comprising selecting a volume of the first reactant pill, a volume of the second reactant pill, or both the volume of the first reactant pill and the volume of the second reactant pill to provide sufficient mixing of the one or the plurality of first reactants of the first reactant pill with the one or the plurality of second reactants of the second reactant pill such that, when subsequent the pumping of the first reactant pill, the spacer, and the second reactant pill into the lost circulation zone, the one or the plurality of first reactants and the one or the plurality of second reactants react to plug the lost circulation zone.

An eighteenth embodiment can include the method of any one of the first to seventeenth embodiments, wherein the seal includes a Sorrell cement.

A nineteenth embodiment can include the method of any one of the first to eighteenth embodiments, wherein the one or the plurality of first reactants include magnesium oxide, a zeolite, or a combination thereof.

A twentieth embodiment can include the method of the nineteenth embodiment, wherein the zeolite includes sepiolite.

A twenty first embodiment can include the method of any one of the first to twentieth embodiments, wherein the one or the plurality of second reactants include magnesium chloride, magnesium sulfate, magnesium phosphate, or a combination thereof.

In a twenty second embodiment, a method of sealing a lost circulation zone encountered during a drilling operation comprises: positioning a bottom hole assembly (BHA) at an initial position proximate a lost circulation zone in a wellbore, wherein the BHA includes a drill bit fluidly connected with a surface of the wellbore via a drill string; pumping a first reactant pill through nozzles of the drill bit while retracting the drill string from the initial position to a second position within the wellbore, wherein the first reactant pill includes one or a plurality of first reactants, and wherein the second position is closer, along a length of the wellbore, to the surface than the initial position; pumping a second reactant pill through the nozzles of the drill bit while retracting the drill string from the second position to a third position within the wellbore, wherein the second reactant pill includes one or a plurality of second reactants, whereby the one or the plurality of second reactants are mixed with the one or the plurality of first reactants, and wherein the third position is closer, along the length of the wellbore, to the surface than the second position; and allowing the one or the plurality of first reactants to react, within the lost circulation zone, with the one or the plurality of second reactants for a reaction time to provide a seal of the lost circulation zone.

A twenty third embodiment can include the method of the twenty second embodiment, further comprising: drilling through the seal and continuing the drilling operation.

A twenty fourth embodiment can include the method of any one of the twenty third or twenty fourth embodiments, further comprising: preventing mixing, within the drill string, of the one or the plurality of first reactants of the first reactant pill with the one or the plurality of second reactants of the second reactant pill by introducing a spacer into the drill string between introducing the first reactant pill into the drill string and introducing the second reactant pill into the drill string, wherein the spacer is not reactive with the one or the plurality of first reactants or with the one or the plurality of second reactants.

A twenty fifth embodiment can include the method of the twenty fourth embodiment, wherein the drilling operation employs a water based drilling fluid, such that, prior to introducing the first reactant pill into the drill string, the drill string contains a water based drilling fluid, wherein the first reactant pill, the second reactant pill, or both the first reactant pill and the second reactant pill are water based pills, and wherein the spacer includes an oil-based spacer.

A twenty sixth embodiment can include the method of the twenty fifth embodiment, further comprising introducing an oil based pill into the drill string prior to the introducing of the first reactant pill into the drill string.

A twenty seventh embodiment can include the method of the twenty fourth embodiment, wherein the drilling operation employs an oil based drilling fluid, such that, prior to introducing the first reactant pill into the drill string, the drill string contains an oil based drilling fluid, wherein the first reactant pill and the second reactant pill are water based pills, and wherein the spacer includes the oil based drilling fluid.

A twenty eighth embodiment can include the method of any one of the twenty second to twenty seventh embodiments, wherein the retracting is operated such that the third position provides a retraction volume within the wellbore between the drill bit and the initial position greater than or equal to a total volume of the first reactant pill, the spacer, and the second reactant pill.

A twenty ninth embodiment can include the method of any one of the twenty second to twenty eighth embodiments, further comprising preventing mixing, within the drill string, of the one or the plurality of first reactants of the first reactant pill with the one or the plurality of second reactants of the second reactant pill by selecting a length, a volume, a density, a pumping rate, and/or a rheology (rheological parameter) of the spacer to prevent the mixing.

A thirtieth embodiment can include the method of the twenty ninth embodiment, further comprising utilizing a model for selecting the length, the volume, the density, the pumping rate, and/or the rheology (rheological parameter) of the spacer.

A thirty first embodiment can include the method of any one of the twenty second to thirtieth embodiments further comprising selecting a volume of the first reactant pill, a volume of the second reactant pill, or both the volume of the first reactant pill and the volume of the second reactant pill to provide sufficient mixing, in the lost circulation zone, of the one or the plurality of first reactants of the first reactant pill with the one or the plurality of second reactants of the second reactant pill, such that the one or the plurality of first reactants and the one or the plurality of second reactants react to seal the lost circulation zone.

A thirty second embodiment can include the method of any one of the twenty second to thirty first embodiments comprising pumping a plurality of first reactant pills, a plurality of second reactant pills, or both a plurality of first reactant pills and a plurality of second reactant pills into the lost circulation zone, wherein each of the plurality of first reactant pills, other than a first of the plurality of first reactant pills introduced into the drill string, is introduced into the drill string subsequent introducing into the drill string of a second reactant pill followed by introducing into the drill string of a spacer, and wherein each of the plurality of second reactant pills is introduced into the drill string subsequent introducing into the drill string of a first reactant pill followed by introducing into the drill string of a spacer.

A thirty third embodiment can include the method of any one of the twenty second to thirty second embodiments, wherein retracting of the drill string is effected at a speed such that a hole volume created by the retracting of the drill string is greater than or equal to a volume being ejected from the drill string via the drill bit.

A thirty fourth embodiment can include the method of the thirty third embodiment, wherein the speed is such that: S (ft/min)=24.511*Q/$D^2$, wherein S is the speed (ft/min), Q is a pumping flow rate (US gal/min), and D is an inside diameter of the wellbore (in).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as includes, includes, having, etc. should be understood to provide support for narrower terms such as consisting of, consisting essentially of, included substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method of sealing a lost circulation zone during a drilling operation, the method comprising:

positioning a bottom hole assembly (BHA) at an initial position proximate a lost circulation zone in a wellbore, wherein the BHA includes a drill bit fluidly connected with a surface of the wellbore via a drill string;

sequentially pumping downhole, via an interior of the drill string and out nozzles of the drill bit, a first reactant pill, a spacer, and a second reactant pill, wherein the first reactant pill includes one or a plurality of first reactants, wherein the second reactant pill includes one or a plurality of second reactants, wherein the spacer is not reactive with the one or the plurality of first reactants or with the one or the plurality of second reactants, wherein the first reactant pill is pumped out of the BHA via the nozzles on the drill bit into the lost circulation zone prior to pumping of the second reactant pill out of the BHA via the nozzles on the drill bit into the lost circulation zone due to introducing of the spacer into the interior of the drill string between introducing into the interior of the drill string of the first reactant pill and introducing into the interior of the drill string of the second reactant pill, and wherein, after a reaction time, reactants comprising the one or the plurality of first reactants of the first reactant pill and the one or the plurality of second reactants of the second reactant pill react within and provide a seal of the lost circulation zone; and retracting the drill string from the wellbore while pumping one or more of the first reactant pill, the spacer, or the second reactant pill into the wellbore via the drill bit, wherein the retracting of the drill string is effected at a speed such that a hole volume created by the retracting of the drill string is greater than or equal to a volume being ejected from the drill string into the wellbore via the drill bit, and wherein the speed is such that:

S (ft/min)=24.511*Q/$D^2$, wherein S is the speed (ft/min), Q is a pumping flow rate (US gal/min), and D is an inside diameter of the wellbore (in).

2. The method of claim 1 further comprising:

drilling through the seal and continuing the drilling operation.

3. The method of claim 1, wherein, prior to the pumping of the first reactant pill, the spacer, and the second reactant pill into the lost circulation zone, the wellbore contains a water based drilling fluid, wherein the first reactant pill, the second reactant pill, or both the first reactant pill and the second reactant pill are water based pills, and wherein the spacer is an oil-based spacer.

4. The method of claim 3 further comprising introducing an oil based pill into the drill string prior to the introducing of the first reactant pill into the drill string.

5. The method of claim 1, wherein, prior to pumping the first reactant pill, the spacer, and the second reactant pill into the lost circulation zone, the wellbore contains an oil based drilling fluid, wherein the first reactant pill and the second reactant pill are water based pills, and wherein the spacer includes the oil based drilling fluid.

6. The method of claim 1 further comprising retracting the drill string from the wellbore while pumping one or more of the first reactant pill, the spacer, or the second reactant pill into the wellbore via the drill bit.

7. The method of claim 6, wherein retracting of the drill string is effected at a speed such that a hole volume created by the retracting of the drill string is greater than or equal to a volume being ejected from the drill string into the wellbore via the drill bit.

8. The method of claim 7, wherein the retracting is operated such that the drill string is retracted, from the initial position, at least a minimum distance that provides a retraction volume within the wellbore between the drill bit and the initial position equal to a total volume of the first reactant pill, the spacer, and the second reactant pill during the pumping of the first reactant pill, the spacer, and the second reactant pill into the lost circulation zone.

9. A method of sealing a lost circulation zone during a drilling operation, the method comprising:

positioning a bottom hole assembly (BHA) at an initial position proximate a lost circulation zone in a wellbore, wherein the BHA includes a drill bit fluidly connected with a surface of the wellbore via a drill string;

pumping a first reactant pill, a spacer, and a second reactant pill into the lost circulation zone via the drill string and the drill bit, wherein the first reactant pill includes one or a plurality of first reactants, wherein the second reactant pill includes one or a plurality of second reactants, wherein the spacer is not reactive with the one or the plurality of first reactants or with the one or the plurality of second reactants, wherein the first reactant pill is pumped into the lost circulation zone prior to pumping of the second reactant pill into the lost circulation zone due to introducing of the spacer into the drill string between introducing into the drill string of the first reactant pill and introducing into the drill string of the second reactant pill, and wherein, after a reaction time, reactants comprising the one or the plurality of first reactants of the first reactant pill and the one or the plurality of second reactants of the second reactant pill react within and provide a seal of the lost circulation zone; and retracting the drill string from the wellbore while pumping one or more of the first reactant pill, the spacer, or the second reactant pill into the wellbore via the drill bit, wherein the retracting of the drill string is effected at a speed such that a hole volume created by the retracting of the drill string is greater than or equal to a volume being ejected from the drill string into the wellbore via the drill bit, and wherein the speed is such that:

S (ft/min)=24.511*Q/$D^2$, wherein S is the speed (ft/min), Q is a pumping flow rate (US gal/min), and D is an inside diameter of the wellbore (in).

10. A method of sealing a lost circulation zone during a drilling operation, the method comprising:

positioning a bottom hole assembly (BHA) at an initial position proximate a lost circulation zone in a wellbore, wherein the BHA includes a drill bit fluidly connected with a surface of the wellbore via a drill string;

pumping a first reactant pill, a spacer, and a second reactant pill into the lost circulation zone via the drill string and the drill bit, wherein the first reactant pill includes one or a plurality of first reactants, wherein the second reactant pill includes one or a plurality of second reactants, wherein the spacer is not reactive with the one or the plurality of first reactants or with the one or the plurality of second reactants, wherein the first reactant pill is pumped into the lost circulation zone prior to pumping of the second reactant pill into the lost circulation zone due to introducing of the spacer into the drill string between introducing into the drill string of the first reactant pill and introducing into the drill string of the second reactant pill, and wherein, after a reaction time, reactants comprising the one or the plurality of first reactants of the first reactant pill and the one or the plurality of second reactants of the second reactant pill react within and provide a seal of the lost circulation zone; and retracting the drill string from the wellbore while pumping one or more of the first reactant pill, the spacer, or the second reactant pill into the wellbore via the drill bit, wherein the retracting of the drill string is effected at a speed such that a hole volume created by the retracting of the drill string is greater than or equal to a volume being ejected from the drill string into the wellbore via the drill bit, wherein the retracting is operated such that the drill string is retracted, from the initial position, at least a minimum distance that provides a retraction volume within the wellbore between the drill bit and the initial position equal to a total volume of the first reactant pill, the spacer, and the second reactant pill during the pumping of the first reactant pill, the spacer, and the second reactant pill into the lost circulation zone, and wherein the minimum distance is:

MD=(TV*1029.4)/$D^2$ wherein MD is the minimum distance (ft), TV is the total volume (US barrels) of the first reactant pill, the spacer, and the second reactant pill, and D is an inside diameter of the wellbore (in).

11. A method of sealing a lost circulation zone during a drilling operation, the method comprising:

positioning a bottom hole assembly (BHA) at an initial position proximate a lost circulation zone in a wellbore wherein the BHA includes a drill bit fluidly connected with a surface of the wellbore via a drill string;

sequentially pumping, via an interior of the drill string and out nozzles of the drill bit, a first reactant pill, a spacer, and a second reactant pill into the lost circulation zone, wherein the first reactant pill includes one or a plurality of first reactants, wherein the second reactant pill includes one or a plurality of second reactants, wherein the spacer is not reactive with the one or the plurality of first reactants or with the one or the plurality of second reactants, wherein, after a reaction time, reactants comprising the one or the plurality of first reactants of the first reactant pill and the one or the plurality of second reactants of the second reactant pill react within and provide a seal of the lost circulation zone; and retracting the drill string from the wellbore while pumping one or more of the first reactant pill, the spacer, or the second reactant pill into the wellbore via the drill bit, wherein the retracting of the drill string is effected at a speed such that a hole volume created by the retracting of the drill string is greater than or equal to a volume being ejected from the drill string into the wellbore via the drill bit, and wherein the speed is such that:

S (ft/min)=24.511*Q/$D^2$, wherein S is the speed (ft/min), Q is a pumping flow rate (US gal/min), and D is an inside diameter of the wellbore (in).

12. The method of claim 11 further comprising preventing mixing, within the drill string, of the one or the plurality of first reactants of the first reactant pill with the one or the plurality of second reactants of the second reactant pill by selecting a length, a volume, a density, a pumping rate, and/or a rheological parameter of the spacer to prevent the mixing.

13. The method of claim 11 further comprising selecting a volume of the first reactant pill, a volume of the second reactant pill, or both the volume of the first reactant pill and the volume of the second reactant pill to provide sufficient mixing of the one or the plurality of first reactants of the first reactant pill with the one or the plurality of second reactants of the second reactant pill such that, subsequent the pumping of the first reactant pill, the spacer, and the second reactant pill into the lost circulation zone, the one or the plurality of first reactants and the one or the plurality of second reactants react to plug the lost circulation zone.

14. A method of sealing a lost circulation zone during a drilling operation, the method comprising:

positioning a bottom hole assembly (BHA) at an initial position proximate a lost circulation zone in a wellbore, wherein the BHA includes a drill bit fluidly connected with a surface of the wellbore via a drill string;

pumping downhole, via an interior of the drill string and out the nozzles of the drill bit, a first reactant pill while retracting the drill string from the initial position to a second position within the wellbore, wherein the first reactant pill includes one or a plurality of first reactants, and Wherein the second position is closer, along a length of the wellbore, to the surface than the initial position;

sequentially pumping downhole, via the interior of the drill string and out nozzles of the drill bit, a second reactant pill while retracting the drill string from the second position to a third position within the wellbore, wherein the second reactant pill includes one or a plurality of second reactants, whereby the one or the plurality of second reactants are mixed with the one or the plurality of first reactants, and wherein the third position is closer, along the length of the wellbore, to the surface than the second position;

allowing the one or the plurality of first reactants to react, within the lost circulation zone, with the one or the plurality of second reactants for a reaction time to provide a seal of the lost circulation zone; and retracting the drill string from the wellbore while pumping one or more of the first reactant pill, the spacer, or the second reactant pill into the wellbore via the drill bit, wherein the retracting of the drill string is effected at a speed such that a hole volume created by the retracting of the drill string is greater than or equal to a volume being ejected from the drill string into the wellbore via the drill bit, and wherein the speed is such that:

S (ft/min)=24.511*Q/$D^2$, wherein S is the speed (ft/min), Q is a pumping flow rate (US gal/min), and D is an inside diameter of the wellbore (in).

15. The method of claim 14 further comprising:

drilling through the seal and continuing the drilling operation.

16. The method of claim 14 further comprising: preventing mixing, within the drill string, of the one or the plurality of first reactants of the first reactant pill with the one or the plurality of second reactants of the second reactant pill by introducing a spacer into the drill string between introducing the first reactant pill into the drill string and introducing the second reactant pill into the drill string, wherein the spacer is not reactive with the one or the plurality of first reactants or with the one or the plurality of second reactants.

17. The method of claim 16, wherein the drilling operation employs a water based drilling fluid, such that, prior to introducing the first reactant pill into the drill string, the drill string contains a water based drilling fluid, wherein the first reactant pill, the second reactant pill, or both the first reactant pill and the second reactant pill are water based pills, and wherein the spacer includes an oil-based spacer.

18. The method of claim 17 further comprising introducing an oil based pill into the drill string prior to the introducing of the first reactant pill into the drill string.

19. The method of claim 16, wherein the drilling operation employs an oil based drilling fluid, such that, prior to introducing the first reactant pill into the drill string, the drill string contains an oil based drilling fluid, wherein the first reactant pill and the second reactant pill are water based pills, and wherein the spacer includes the oil based drilling fluid.

20. The method of claim 14, wherein the retracting is operated such that the third position provides a retraction volume within the wellbore between the drill bit and the initial position greater than or equal to a total volume of the first reactant pill, the spacer, and the second reactant pill.

* * * * *